US012313273B2

(12) United States Patent
Notaro et al.

(10) Patent No.: US 12,313,273 B2
(45) Date of Patent: *May 27, 2025

(54) SYSTEMS AND METHODS FOR AIR TEMPERATURE CONTROL INCLUDING A2L SENSORS

(71) Applicant: Goodman Manufacturing Company LP, Waller, TX (US)

(72) Inventors: Douglas Notaro, Cypress, TX (US); Masahiro Honda, Cypress, TX (US); Mark Kendall, Tomball, TX (US); Hiroshi Yoh, Cypress, TX (US); Yenny Natali Martinez, Houston, TX (US); Patrick Wang, Katy, TX (US); Roberto Flores, Cypress, TX (US); Timmy Ta, Cypress, TX (US)

(73) Assignee: Goodman Manufacturing Company LP, Waller, TX (US)

( * ) Notice: Subject to any disclaimer, the term of this patent is extended or adjusted under 35 U.S.C. 154(b) by 52 days.

This patent is subject to a terminal disclaimer.

(21) Appl. No.: 18/305,980

(22) Filed: Apr. 24, 2023

(65) Prior Publication Data

US 2023/0266026 A1 Aug. 24, 2023

Related U.S. Application Data

(63) Continuation of application No. 17/164,598, filed on Feb. 1, 2021, now Pat. No. 11,668,483.

(51) Int. Cl.
*F24F 11/36* (2018.01)
*F24F 11/38* (2018.01)
(Continued)

(52) U.S. Cl.
CPC ..... *F24F 11/36* (2018.01); *F24F 11/38* (2018.01); *F24F 11/49* (2018.01); *F24F 11/88* (2018.01); *F24F 11/89* (2018.01)

(58) Field of Classification Search
CPC .. F24F 11/36; F24F 11/38; F24F 11/49; F24F 11/88; F24F 11/89
See application file for complete search history.

(56) References Cited

U.S. PATENT DOCUMENTS 10,852,044 B1 * 12/2020 Elliott ..... F04D 27/004
10,914,482 B2 2/2021 Yamamoto et al.
(Continued)

FOREIGN PATENT DOCUMENTS

CN 206593243 U 10/2017
JP H06-309579 A 11/1994
(Continued)

OTHER PUBLICATIONS

International Search Report and Written Opinion issued in related PCT Application No. PCT/US2022/014623 mailed May 10, 2022, 11 pages.
(Continued)

*Primary Examiner* — Ramesh B Patel
(74) *Attorney, Agent, or Firm* — Baker Botts L.L.P.

(57) ABSTRACT

The present invention provides a system for detecting an amount of A2L refrigerant in an air temperature controller using an A2L refrigerant, and a method of installing a configuration of A2L sensors in the air temperature controller using an A2L refrigerant. The system includes an A2L control board, a first A2L sensor, and a second A2L sensor. The first A2L sensor and the second A2L sensor are coupled in series and electrically coupled to the A2L control board. Each of the first A2L sensor and the second A2L sensor include sensing components configured to detect the amount of A2L refrigerant.

14 Claims, 10 Drawing Sheets

(51) Int. Cl.

| | |
|---|---|
| ***F24F 11/49*** | (2018.01) |
| ***F24F 11/88*** | (2018.01) |
| ***F24F 11/89*** | (2018.01) |

(56) References Cited

U.S. PATENT DOCUMENTS

| | | | | |
|---|---|---|---|---|
| 11,125,457 | B1 * | 9/2021 | Alfano | F24F 11/52 |
| 11,408,624 | B2 * | 8/2022 | Hovardas | G01N 21/61 |
| 11,662,110 | B2 * | 5/2023 | Notaro | F24F 11/77 165/11.1 |
| 11,668,483 | B2 * | 6/2023 | Notaro | F24F 11/88 700/276 |
| 11,920,805 | B2 * | 3/2024 | Notaro | F24F 11/77 |
| 11,927,377 | B2 * | 3/2024 | Hammond | F25B 49/02 |
| 11,953,239 | B2 * | 4/2024 | Brown | F25B 30/02 |
| 11,971,183 | B2 * | 4/2024 | Jaber | G01M 3/24 |
| 2007/0131784 | A1 * | 6/2007 | Garozzo | F24F 11/871 236/51 |
| 2019/0390876 | A1 * | 12/2019 | Matsuda | F25B 13/00 |
| 2020/0248919 | A1 * | 8/2020 | Green | G05B 23/027 |
| 2020/0263891 | A1 * | 8/2020 | Noor | F24F 11/61 |
| 2022/0042698 | A1 * | 2/2022 | Butler | F24F 11/89 |
| 2022/0243938 | A1 * | 8/2022 | Notaro | F24F 11/36 |
| 2022/0243940 | A1 * | 8/2022 | Notaro | F24F 11/88 |
| 2022/0243941 | A1 | 8/2022 | Notaro | |

FOREIGN PATENT DOCUMENTS

| | | | |
|---|---|---|---|
| JP | 2020-198220 | A | 12/2020 |
| WO | 2017149625 | A1 | 9/2017 |
| WO | 2020/021661 | A1 | 1/2020 |

OTHER PUBLICATIONS

Office action mailed Aug. 31, 2022, U.S. Appl. No. 17/164,575, filed Feb. 1, 2022.

Office action mailed Sep. 21, 2022, U.S. Appl. No. 17/164,618, filed Feb. 1, 2022.

* cited by examiner

SYSTEMS AND METHODS FOR AIR TEMPERATURE CONTROL INCLUDING A2L SENSORS

RELATED APPLICATIONS

This application is a continuation of U.S. patent application Ser. No. 17/164,598 filed Feb. 1, 2021, now U.S. Pat. No. 11,668,483, the contents of which are incorporated by reference in their entirety.

TECHNICAL FIELD

The present invention relates to heating, ventilation, and air-conditioning (HVAC) systems, and more particularly to HVAC systems using an American Society of Heating, Refrigeration, and Air Conditioning Engineers (ASHRAE) Standard 34 classified "A2L" refrigerant.

BACKGROUND

Modern residential and industrial buildings use HVAC systems to keep indoor spaces climate controlled. In general, HVAC systems circulate air over low-temperature or high-temperature sources and distribute the cooled or heated air throughout the building to adjust the indoor ambient air temperature. Modern HVAC systems have used the well-known physical principle that a fluid transitioning from gas to liquid releases heat, while a fluid transitioning from liquid to gas absorbs heat, in order to efficiently cool or heat the air before distribution. Typical HVAC systems circulate a fluid refrigerant through a closed loop of tubing, using compressors and other devices to manipulate the refrigerant and cause it to cycle between its liquid and gas phases. Generally, these phase transitions occur within the HVAC's evaporator and condensing coils, which are part of the closed loop and designed to transfer heat between the circulating refrigerant and flowing ambient air.

For a long time, HVAC systems used, and in some places continue to use, a chemical called R-12 or a chemical called R-22 as the refrigerant in the system. While R-12 and R-22 are both classified as "A1" refrigerants under ASHRAE Standard 34, which means they are non-flammable and have lower toxicity, they both posed great threats to the ozone and environment. R-22, while an improvement over R-12 in that it had a much lower ozone depletion potential (ODP) (0.05 for R-22 compared to 1.0 for R-12) and global warming potential (GWP) (1,760 for R-22 compared to 10,200 for R-12), still had adverse effects on the ozone and environment. Thus, in an attempt to solve the ozone depletion issue, the industry, with the help of regulations, began transitioning to the use of R-410A, which is another A1 refrigerant but with an ODP of 0. However, R-410A has a GWP (2,088) that is even higher than that of R-22.

Thus, in an attempt to solve the global warming issue created by the use of the above refrigerants, the industry has begun to move from the use of A1 refrigerants to those classified as A2L refrigerants, which means that the refrigerants are still low toxicity but instead of being non-flammable, they have very low flammability. Generally, these A2L refrigerants have much lower GWP than the A1 refrigerants currently and previously used while still having an ODP of 0 like R-410A. Some examples of viable A2L refrigerants include, but are not limited to, R-32 and R-454b, both of which have an ODP of 0 and a GWP of 675 and 466, respectively. However, this now means that HVAC systems incorporating these A2L refrigerants need to employ safety measures to make sure that the refrigerants do not ignite in case there is a leak of A2L refrigerant. Some of these safety requirements for systems using A2L refrigerants include turning on a blower in the HVAC system while shutting off all other components of the HVAC system within the requisite time after detection of an A2L refrigerant leak as required by A2L safety standards. Present HVAC systems are not only unable to achieve these requirements within the required time, but they are unable to detect A2L leaks.

SUMMARY

The present invention is directed to a system for detecting an amount of A2L refrigerant in an air temperature controller using an A2L refrigerant, and a method of installing a configuration of A2L sensors in the air temperature controller using the A2L refrigerant. The system includes an A2L control board, a first A2L sensor, and a second A2L sensor. The first A2L sensor and second A2L sensor are coupled in series and electrically coupled to the A2L control board. Further, each of the first A2L sensor and the second A2L sensor include sensing components configured to detect the amount of A2L refrigerant. In one or more embodiments described herein, each of the first A2L sensor and the second A2L sensor include a sensor relay electrically disposed between a bus connector input and a bus connector output. Additionally, in one or more embodiments described herein, each of the first A2L sensor and the second A2L sensor run an internal self-diagnostic test, and if the sensor passes the internal self-diagnostic test, the sensor closes the sensor relay allowing power to pass through the sensor.

The method of installing the configuration of A2L sensors in an air temperature controller using an A2L refrigerant includes disposing the A2L control board, the first A2L sensor, and the second A2L sensor into the air temperature controller. Further, the first A2L sensor is electrically coupled to the A2L control board and the second A2L sensor is coupled to the A2L control board. Additionally, the first A2L sensor and the second A2L sensor are coupled in series to the A2L control board. In one or more embodiments described herein, each of the first A2L sensor and the second A2L sensor run an internal self-diagnostic test, and if the sensor passes the internal self-diagnostic test, the sensor closes its sensor relay allowing power to pass through the sensor.

The HVAC systems as disclosed herein provide components and architecture that allow for detection of leaks of A2L refrigerant and for meeting the safety requirements within the required time. Additionally, within the HVAC systems, the components and architecture of the systems for detecting the amount of A2L refrigerant as disclosed herein ensure that the system meets the safety requirements by ensuring that all A2L sensors are operating properly while an HVAC system is running. Thus, a system for detecting the amount of A2L refrigerant may be installed such that HVAC systems incorporating A2L refrigerants operate safely while reducing the negative environmental impact caused by present HVAC systems. The foregoing and other objects, features, and advantages of the invention will be apparent from the following more particular description of the invention, as illustrated in the accompanying drawings, wherein like reference numbers represent like parts of the invention.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DESCRIPTION

This disclosure generally relates to non-communicating and communicating HVAC systems designed to incorporate the use of an A2L refrigerant and meet the safety standards imposed on systems using A2L refrigerants.

Figure 1:
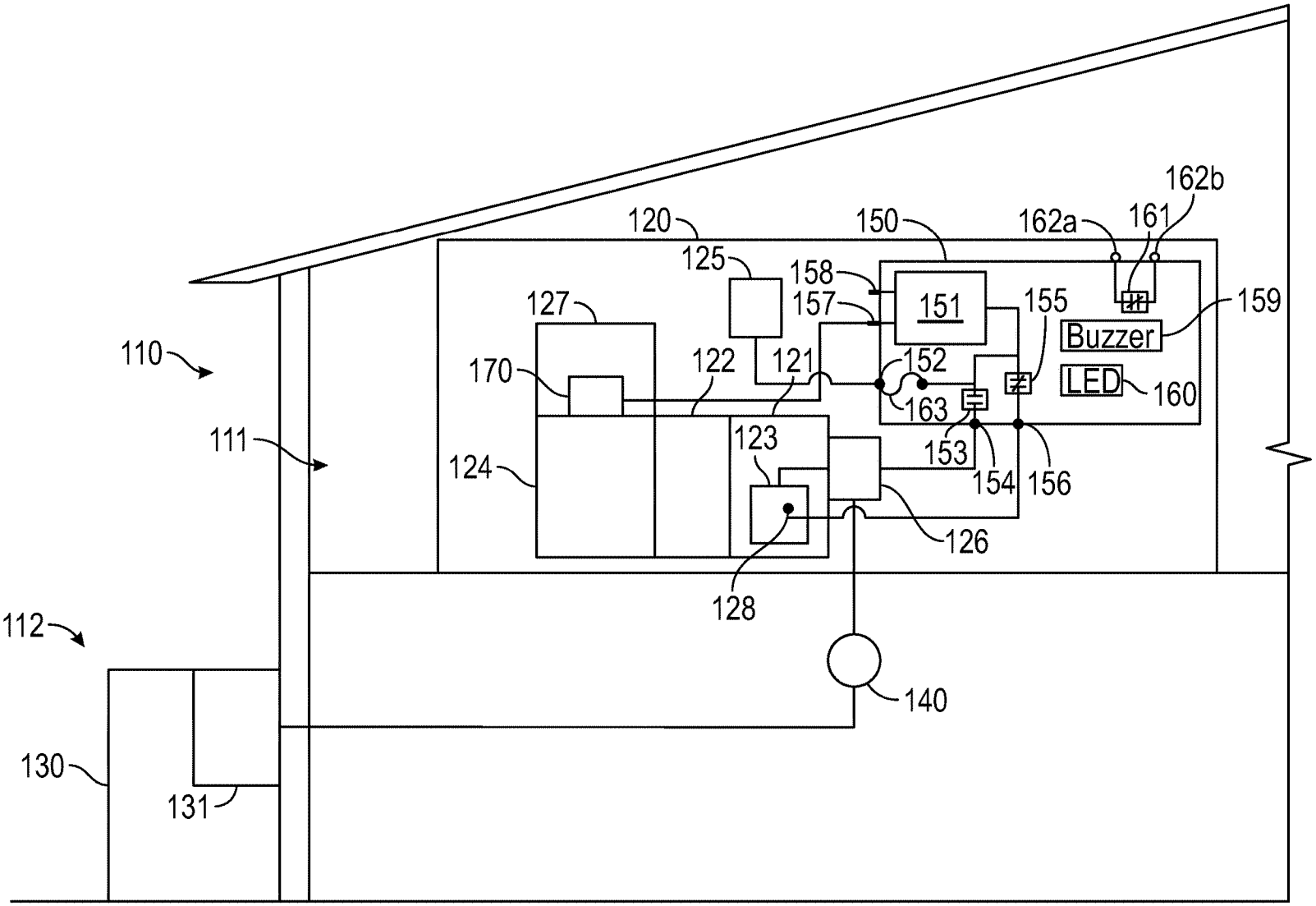
FIG. 1 shows a non-communicating HVAC system using an A2L refrigerant, according to one or more embodiments.

FIG. 1 shows a non-communicating HVAC system using an A2L refrigerant, according to one or more embodiments. In one or more embodiments, an HVAC system 100 may be used to distribute cooled or heated air throughout a building 110 to adjust the ambient air temperature inside 111 of the building 110. The HVAC system may include an indoor unit 120, an outdoor unit 130, a thermostat 140, an A2L control board 150, and an A2L sensor 170. Generally, in one or more embodiments, the indoor unit 120 may be fluidly coupled to the outdoor unit 130 such that an A2L refrigerant may flow between the indoor unit 120 and the outdoor unit 130 to cool or heat air within the indoor unit 120. Further, in one or more embodiments, both the indoor unit 120 and the outdoor unit 130 may be electrically coupled to the thermostat 140. The thermostat 140 may be configured to use on/off-type signals for communication and control of the indoor unit 120 and the outdoor unit 130. Furthermore, in one or more embodiments, the A2L control board 150 may be directly electrically coupled to the indoor unit 120 and the A2L sensor 170. The A2L control board 150 may act as a passthrough for power to portions of the indoor unit 120, the outdoor unit 130, and the thermostat 140 and may be configured to block power from getting to certain parts of the indoor unit 120, the outdoor unit 130, and the thermostat 140 if there is an A2L refrigerant leak in the system. Additionally, an A2L sensor 170 may be physically disposed within the indoor unit 120 and electrically coupled to the A2L control board 150. The A2L sensor 170 may be configured to send signals to the A2L control board 150 when an A2L refrigerant leak is detected.

In one or more embodiments, indoor unit 120 may be disposed on the inside 111 of the building 110. The indoor unit 120 may be configured to distribute cooled or heated air to rooms on the inside 111 of the building 110. The indoor unit 120 may be any type of HVAC system that includes a blower 121 and a heat exchanger 127 having an indoor evaporator coil 124. Thus, in one or more embodiments, the indoor unit 120 may be either a furnace or an air handler, as both types of system include, at least, a blower and an indoor evaporator coil. Additionally, the indoor evaporator coil 124 may be disposed adjacent to the blower 121, such that when the blower 121 blows air within the indoor unit 120, the air is blown through the evaporator coil 124.

Further, in one or more embodiments, the blower 121 may include a blower fan 122 and a blower motor 123. By way of example, in one or more embodiments, the blower motor 123 may be constant torque motor, while in other embodiments, the blower motor 123 may be a permanent split capacitor (PSC) motor. The blower motor 123 may be mechanically coupled to the blower fan 122 such that when the blower motor 123 is turned on, the blower fan 122 is configured to spin and cause a movement of air out from the blower 121 and through the indoor evaporator coil 124. The indoor evaporator coil 124 may be configured to receive the A2L refrigerant on the inside of the coil while air from the blower 121 is blown across the outside of the coil, which allows for heat to exchange either from the A2L refrigerant to the air or vice versa. The A2L refrigerant, after cooling or heating the air, may be cycled back to the outdoor unit 130, where it will go through the reverse heat exchange process before returning to the indoor evaporator coil 124. Additionally, indoor unit 120 is configured to distribute the air that is blown from the blower 121 and across the indoor evaporator coil 124 to the rooms on the inside 111 of the building 110 by way of the force of the blower 121.

The indoor unit 120 may also include a transformer 125 and an indoor control board 126. The transformer 125 may be directly electrically coupled to and configured to provide 24 volts A/C power to the A2L control board 150. Further, the indoor control board 126 may be electrically coupled to the A2L control board 150 such that the indoor control board 126 may receive 24 volts A/C power indirectly from the transformer 125. Additionally, the indoor control board 126 may be electrically coupled to, at least, the blower motor 123 and the thermostat 140. In one or more embodiments, the transformer 125 may be configured to indirectly provide a 24 volt A/C power to both the blower motor 123 and the thermostat 140 by way of indoor control board 126 and the A2L control board 150. In one or more embodiments, the blower motor has its own source of power. So, while the 24 volt A/C power that the blower motor receives does not power on the blower motor 123, the 24 volt A/C signal is needed to turn the blower motor 123 on. By way of example only, in one or more embodiments, the indoor control board 126 may be configured to provide power to the thermostat 140, the thermostat 140 may be configured to send a signal to the indoor control board 126 to turn on the blower motor 123, and the indoor control board 126 may be configured to provide power to the blower motor 123 to turn it on.

Further, the outdoor unit 130 may be disposed on an outside 112 of the building 110 and be configured to use the outdoor environment to reheat or cool down the A2L refrigerant after it has been run through the indoor evaporator coil 124. The outdoor unit 130 may include, but is not limited to, either a heat pump or an air conditioner. Whether the outdoor unit 130 is a heat pump or an air conditioner, the outdoor unit 130 may include a compressor (not shown), an outdoor coil (not shown), and an outdoor control board 131. The outdoor unit 130 may be configured to receive power through the outdoor control board 131, which itself is configured to receive power from the transformer 125 by way of the thermostat 140, the indoor control board 126, and the A2L control board 150. By way of example only, in one or more embodiments, the outdoor control board 131 may be configured to receive power and control signals from the thermostat 140, such that outdoor control board 131 may start the condenser after receiving a signal from the thermostat 140 to do so.

Still referring to FIG. 1, in one or more embodiments, the A2L sensor 170 may be configured to detect an A2L refrigerant leak and send a signal reporting as much. In one or more embodiments, the A2L sensor 170 may be configured to detect an A2L refrigerant leak by one of a number of methods, including, at least, by detecting an amount or a concentration of A2L refrigerant in the air that exceeds a leak threshold. The A2L sensor 170 may be electrically coupled to and communicate with the A2L control board 150. In one or more embodiments, the A2L sensor 170 may be electrically coupled to the A2L control board 150 by way of a first sensor connector 157. The A2L sensor 170 may be configured to communicate to the A2L control board 150 that the A2L sensor 170 is connected to the system and working properly. Additionally, when the A2L sensor 170 detects an A2L refrigerant leak, it may communicate the A2L refrigerant leak to the A2L control board 150, which may be configured to receive the signal and perform the safety measures required by A2L safety standards. In one or more embodiments, the A2L sensor 170 and the A2L control board 150 may be electrically coupled by way of an RS-485 bus; however, one of ordinary skill in the art would understand that any type of electrical connection that allows the A2L sensor 170 to send a signal to the A2L control board 150 may be used.

While the A2L sensor 170 is depicted as being electrically and communicatively coupled to the A2L control board 150 by way of a wired connection, one of ordinary skill in the art would understand that the A2L sensor 170 may just be communicatively coupled to the A2L control board 150 wirelessly. In one or more embodiments, the A2L sensor 170 may be communicatively coupled to the A2L control board 150 by any wireless means, such as Wi-Fi or Bluetooth.

Further, in one or more embodiments, the A2L sensor 170 may be disposed within the indoor unit 120 so that it may detect an A2L refrigerant leak that occurs within the indoor evaporator coil 124 of the HVAC system 100. As depicted, in one or more embodiments, the A2L sensor 170 may be disposed directly against the indoor evaporator coil to minimize the time it takes for the A2L sensor 170 to detect an A2L refrigerant leak. Further, while the A2L sensor 170 is depicted within the indoor unit 120, one or ordinary skill in the art would understand that the A2L sensor 170 may instead be disposed within the outdoor unit 130. Further, while a single sensor is depicted, one of ordinary skill in the art would understand that multiple sensors may be incorporated into the HVAC system to ensure that an A2L refrigerant leak is detected and the required safety measures are taken within the time required by A2L safety standards. For example, one of ordinary skill in the art would understand that the HVAC system may include two A2L sensors, with both A2L sensors disposed within the indoor unit, both A2L sensors disposed within the outdoor unit, or one A2L sensor disposed within each of the indoor unit and the outdoor unit. Thus, one of ordinary skill in the art would understand that in one or more embodiments, a plurality of A2L sensors may be disposed within the HVAC system with one or more A2L sensors disposed within the indoor unit and/or one or more A2L sensors disposed within the outdoor unit as may be determined necessary to ensure that an A2L refrigerant leak is detected and the required safety measures are taken within the time required by A2L safety standards.

Additionally, referring to FIG. 1, in one or more embodiments, the A2L control board 150 may be disposed inside of the indoor unit 120. However, one of ordinary skill in the art would understand that, in one or more embodiments, the A2L control board 150 may be disposed outside of the indoor unit 120 and either connected to the indoor unit 120 or adjacent to the indoor unit 120. Further, in addition to being electrically coupled to the transformer 125, the indoor control board 126, and the A2L sensor 170, as discussed above, the A2L control board 150 may be electrically coupled to the blower motor 123. In one or more embodiments, the A2L control board 150 may be configured to signal the blower motor 123 to run either by way of a 24 volt A/C line connected to an input lead 128 on the blower motor 123, if the blower motor 123 is a constant torque motor, or by way of a line voltage provided to the input lead 128 of the blower motor 123, if the blower motor 123 is a PSC motor.

In one or more embodiments, the A2L control board 150 may include a power supply 151, a power-in contact point 152, a first relay 153, a first power-out contact point 154, a second relay 155, a second power-out contact point 156, a first sensor connector 157, a second sensor connector 158, a buzzer 159, a light emitting diode (LED) 160, a dry contact relay 161, first and second ventilator contact points **162*a* and 162*b*, and a fuse 163. The power supply 151 may be coupled to circuitry on the A2L control board 150 such that the A2L control board may open and close, at least, the first relay 153, the second relay 154, and the dry contact relay 161. Further, in one or more embodiments, the first relay 153 may be electrically disposed between the power-in contact point 152 and the first power-out contact point 154, such that when the first relay 153 is open, power from the power-in contact point 152 does not reach the first power-out contact point 154. Furthermore, the fuse 163 may be electrically disposed between the power-in contact point 152 and the first relay 153. Similarly, in one or more embodiments, the second relay 155 may be electrically disposed between the power-in contact point 152 and the second power-out contact point 156, such that when the second relay 155 is open, power from the power-in contact point 152 does not reach the second power-out contact point 156. Additionally, the fuse 163 may be electrically disposed between the power-in contact point 152 and the second relay 155. By way of example, in one or more embodiments, when the first relay 153 is open, the second relay 155 is closed, and when the second relay 155 is open, the first relay 153 is closed. Further, in one or more embodiments, in the default state, the first relay 153 is open and the second relay 155** is closed.

In one or more embodiments, the transformer 125 may be electrically coupled to the power-in contact point 152, the first power-out contact point 154 may be electrically coupled to the indoor control board 126, and the second power-out contact point 156 may be electrically coupled to the blower motor 123. FIG. 1 displays a default state of the A2L control board 150, where the 24 volt A/C power coming from the transformer 125 is routed to the blower motor 123, causing it to run. Further, in one or more embodiments, if the A2L control board 150 fails, the relays all revert to their default state, and thus, if the A2L control board 150 fails, power will be directed to the blower motor 123. Furthermore, in one or more embodiments, when the A2L control board 150 is turned on, the second relay 154 immediately opens so that the blower motor 123 is not unnecessarily run. Additionally, after the A2L control board 150 is turned on, when the system is ready to run, the first relay 152 is closed, turning on the HVAC system 100.

Further, in one or more embodiments, the power supply 151 may be coupled to the first sensor connector 157 and the second sensor connector 158, separately. Thus, in one or more embodiments, the A2L control board 150 may separately test one or more A2L sensors 170 before closing the first relay 153 and powering up the HVAC system 100. This allows for the A2L control board 150 to make sure that the sensors 170 are working properly and there are no A2L refrigerant leaks before beginning the system. While two separate sensor connectors are depicted, one of ordinary skill in the art would understand that the A2L control board may instead include a sensor signal-in contact and a sensor signal-out contact and the one or more sensors may be run in series instead of in parallel.

Thus, when the A2L control board 150 receives a signal from the A2L sensor 170 that there is an A2L refrigerant leak, the A2L control board 150 may be configured to carry out the required safety measures required by A2L safety standards. More specifically, in one or more embodiments, if a leak is detected, the A2L control board 150 may be configured to cut off power to the indoor control board 126 by opening the first relay 153, while directing power directly to the blower motor 123 by closing the second relay 155. Since the indoor unit 120, the thermostat 140, and the outdoor unit 130 receive power from the indoor control board 126, when the A2L sensor detects an A2L refrigerant leak and the A2L control board 150 cuts power to the indoor control board 126, the entire HVAC system 100, besides the blower motor 123, is configured to lose power and shut off. This allows the HVAC system 100 to meet the A2L safety requirements within the requisite time after detection of an A2L refrigerant leak.

Additionally, as discussed above, in one or more embodiments, the A2L control board 150 may include a buzzer 159, an LED 160, a dry contact relay 161, and first and second ventilator contact points 162*a* and 162*b*. In one or more embodiments, the dry contact relay 161 may be electrically coupled to a ventilator (not shown), such that when the A2L control board 150 receives an A2L refrigerant leak signal from the A2L sensor 170, the dry contact relay 161 will flip and turn on the ventilator. Furthermore, in one or more embodiments, when the A2L control board receives an A2L refrigerant leak signal from the A2L sensor, the LED 160 and the buzzer 159 will receive power. When receiving power, the LED 160 will display an error code and the buzzer 159 will make sound in order to give visual and auditory alarms that the HVAC system 100 is experiencing an A2L refrigerant leak.

Figure 2:
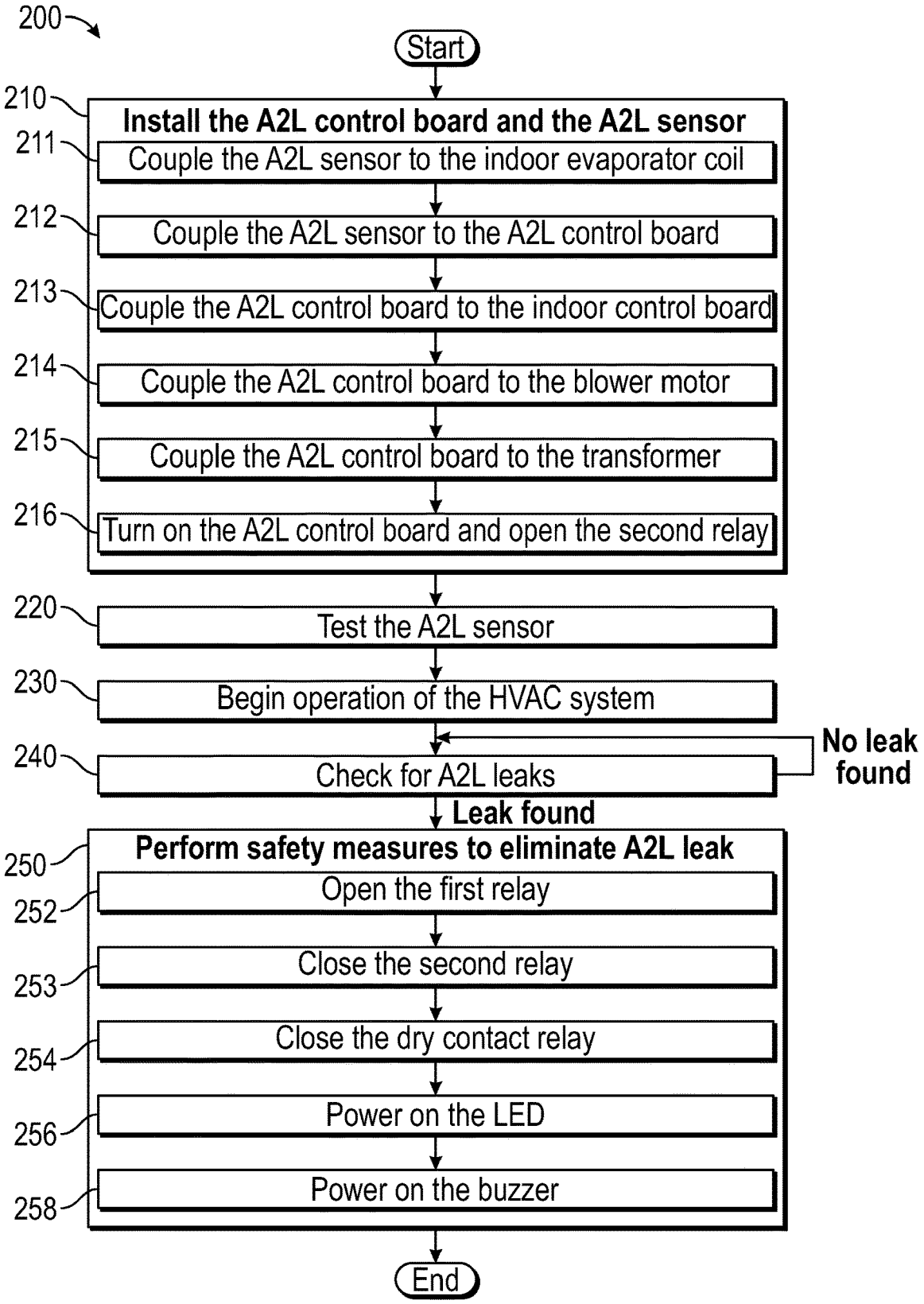
FIG. 2 is a flow chart illustrating an embodiment of a method of operating a non-communicating HVAC system using an A2L refrigerant, according to one or more embodiments.

Referring now to FIG. 2, a flow chart of an embodiment of a method 200 of installing and operating a non-communicating HVAC system using an A2L refrigerant as described above with respect to FIG. 1, according to one or more embodiments, is illustrated. Beginning with an HVAC system 100 in which the indoor unit 120 has been disposed on an inside 111 of a building 110, the outdoor unit 130 has been disposed on an outside 112 of the building 110, the indoor control board 126 has been electrically coupled to the thermostat 140 and a blower motor 123 of the blower 121, and the outdoor control board 131 has been electrically coupled to the thermostat 140, the method 200 may include one or more of the following: (step 210) installing the A2L control board 150 and the A2L sensor 170 into the HVAC system 100, (step 220) testing the A2L sensor 170, (step 230) beginning operation of the HVAC system 100, (step 240) checking for A2L refrigerant leaks, and (step 250) performing safety measures upon detecting an A2L refrigerant leak.

At step 210, an A2L control board 150 and an A2L sensor 170 may be installed into the HVAC system 100. Installation of the A2L control board 150 and the A2L sensor 170 may include, at least, (step 211) physically coupling the A2L sensor 170 to the indoor evaporator coil 124 of the indoor unit 120, (step 212) electrically coupling the A2L sensor 170 to the A2L control board 150, (step 213) electrically coupling the A2L control board 150 to the indoor control board 126, (step 214) electrically coupling the A2L control board 150 to the blower motor 123, (step 215) electrically coupling the A2L control board 150 to the transformer 125, and (step 216) turning on the A2L control board 150 and opening the second relay 155.

In one or more embodiments, at step 211, the A2L sensor 170 may be disposed within the indoor unit 120 such that it is adjacent or connected to the indoor evaporator coil 124 such that the A2L sensor 170 is able to detect an A2L refrigerant leak if one occurs. Further, at step 212, the A2L sensor 170 may be electrically coupled to the A2L control board 150 such that the A2L sensor 170 and the A2L control board 150 have two-way communication between them. By way of example, in one or more embodiments, an A2L sensor 170 may be electrically coupled to a first sensor connector 157 of the A2L control board 150 by way of an RS-485 bus. One of ordinary skill in the art would appreciate that in other embodiments, any other electric coupling that allows for two-way communication between the A2L sensor 170 and the A2L control board 150 may be used.

At step 213, the A2L control board 150 may be electrically coupled to the indoor control board 126. In one or more embodiments, a wire capable of carrying 24 volt A/C power may be electrically coupled on one end to a power-in terminal within the indoor control board 126 and on the other end to a first power-out contact 154 of the A2L control board 150. Thus, once a transformer 125 is electrically coupled to the A2L control board 150, providing a 24 volt A/C power to the A2L control board 150, and a first relay 153 is closed, the indoor control board 126 may receive the 24 volt A/C power.

At step 214, the A2L control board 150 may be electrically coupled to the blower motor 123. In one or more embodiments, a wire capable of carrying 24 volt A/C power may be electrically coupled on one end to an input lead 128 on the blower motor 123 and on the other end to a second power-out contact 156 of the A2L control board 150. Thus, once a transformer 125 is electrically coupled to the A2L control board 150 providing a 24 volt A/C power to the A2L control board 150, the blower motor 123 may receive the 24 volt A/C power whenever the second relay 155 is closed. In one or more embodiments, the default for the second relay 155 may be that it is closed; however, while the HVAC system is running and no A2L leak is detected, the second relay 155 is kept open. Further, in the event that an A2L refrigerant leak is detected, the second relay 155 is closed such that the blower motor 123 may receive the 24 volt A/C power even though the rest of the HVAC system is shut down.

At step 215, the A2L control board 150 may be electrically coupled to the transformer 125. In one or more embodiments, a wire capable of carrying 24 volt A/C power may be electrically coupled on one end to a power-out terminal within the transformer 125 and on the other end to a power-in contact 152 of the A2L control board 150. Thus, once the transformer 125 is electrically coupled to the A2L control board 150, the A2L control board has a 24 volt A/C power that it may distribute to either the indoor control board 126 or the blower motor 123.

At step 216, the A2L control board 150 may be turned on and the second relay 155 may be opened. In one or more embodiments, when the A2L control board 150 is turned on, the relays are in the default state, which includes the second relay 155 being closed. Thus, in order to make sure power is not unnecessarily diverted to the blower motor 123, in one or more embodiments, when the A2L control board 150 powers up, the A2L control board 150 opens the second relay 155.

At step 220, the A2L sensor 170 may be tested to confirm that it is properly operational. Once electrically coupled to the A2L control board 150, in one or more embodiments, the A2L sensor 170 may perform an internal diagnostic check to make sure that the sensor is operating properly and may detect an A2L refrigerant leak. If the diagnostic check is successful, the A2L sensor 170 may communicate the successful diagnostic check to the A2L control board 150, which can begin operation of the HVAC system 100. If the A2L sensor 170 fails the diagnostic check, the A2L sensor 170 will communicate the failed diagnostic check to the A2L control board 150, which will remain in the default configuration, keeping the HVAC system 100 from operating until the A2L sensor is repaired or replaced.

At step 230, the A2L control board 150 may begin operation of the HVAC system 100. In order to begin operation, in one or more embodiments, the A2L control board 150 may close the first relay 153 of the A2L control board 150. Closing the first relay 153 allows for the 24 volt A/C power that the A2L control board 150 receives from the transformer 125 to pass to the indoor control board 126 and power up the rest of the HVAC system 100.

At step 240, while the HVAC system is running, in one or more embodiments, the A2L sensor 170 may check for A2L refrigerant leaks. The A2L sensor 170 may continuously check for A2L refrigerant leaks while the HVAC system 100 is running, such that if a check comes back negative for an A2L refrigerant leak, the A2L sensor 170 repeats step 240. However, if the AL2 sensor 170 detects an A2L leak, then the A2L sensor 170 communicates the A2L refrigerant leak to the A2L control board and the HVAC system continues to step 250.

At step 250, the HVAC system 100, by way of the A2L control board 150, may perform safety measures to eliminate the threat of the detected A2L refrigerant leak. Specifically, the HVAC system 100 may (step 252) open the first relay 153, (step 253) close the second relay 155, (step 254) close the dry contact relay 161, (step 256) power on the LED 160, and (step 258) power on the buzzer 159. At step 252, opening the first relay 153 prevents the 24 volt A/C power that the A2L control board 150 receives from the transformer 125 from passing to the indoor control board 126. Removing the 24 volt A/C power from the indoor control board 126 in turn removes power from the entire HVAC system 100 since the blower motor 123, thermostat 140, and outdoor unit 130 are all configured to receive 24 volt A/C power, either directly or indirectly, from the indoor control board 126. Additionally, at step 253, closing the second relay 155 causes the 24 volt A/C power that the A2L control board 150 receives from the transformer 125 to pass to the blower motor 123 directly. The 24 volt A/C power run directly to the blower motor 123 causes the blower motor 123 to run even though the indoor control board 126 and the thermostat 140 have no power and are turned off. Further, while listed as separate steps, one of ordinary skill would appreciate that in one or more embodiments, either step 252 or step 253 may take place before the other, or in other embodiments, step 252 and step 253 may occur simultaneously. Additionally, one of ordinary skill in the art would appreciate that both steps 252 and 253 may be completed within the requisite time after detection of an A2L refrigerant leak as required by A2L safety standards.

At step 254, in one or more embodiments, the A2L control board 150 may close the dry contact relay 161 that turns on a ventilator. In one or more embodiments, a ventilator may be connected to the HVAC system 100 by way of first and second ventilator contact points 162*a* and 162*b* on the A2L control board 150. Thus, when the A2L sensor 170 detects a leak, the A2L control board 150 may close the dry contact relay 161, which allows power to run directly to the ventilator and turns on the ventilator. Further, at step 256, when the A2L control board 150 receives the A2L refrigerant leak communication, the A2L control board 150 may provide power to the LED 160. Furthermore, at step 258, when the A2L control board 150 receives the A2L refrigerant leak communication, the A2L control board 150 may provide power to the buzzer 159.

Thus, in one or more embodiments, in response to a communication from the A2L sensor 170 that an A2L refrigerant leak has been detected, the A2L control board 150 may turn off the entirety of the HVAC system 100, except the blower motor 123, which is powered on, turn on a ventilator if the HVAC system 100 has one, and turn on visual and auditory alarms that an A2L refrigerant leak has been detected.

While the method 200 is described with respect to an HVAC system 100 including a single A2L sensor 170, one of ordinary skill in the art, would understand that any number of sensors may be used in the system and the method may include electrically coupling the further sensors to the control board, testing the further sensors, and communicating with the further sensors as the further sensors check for A2L refrigerant leaks.

Figure 3:
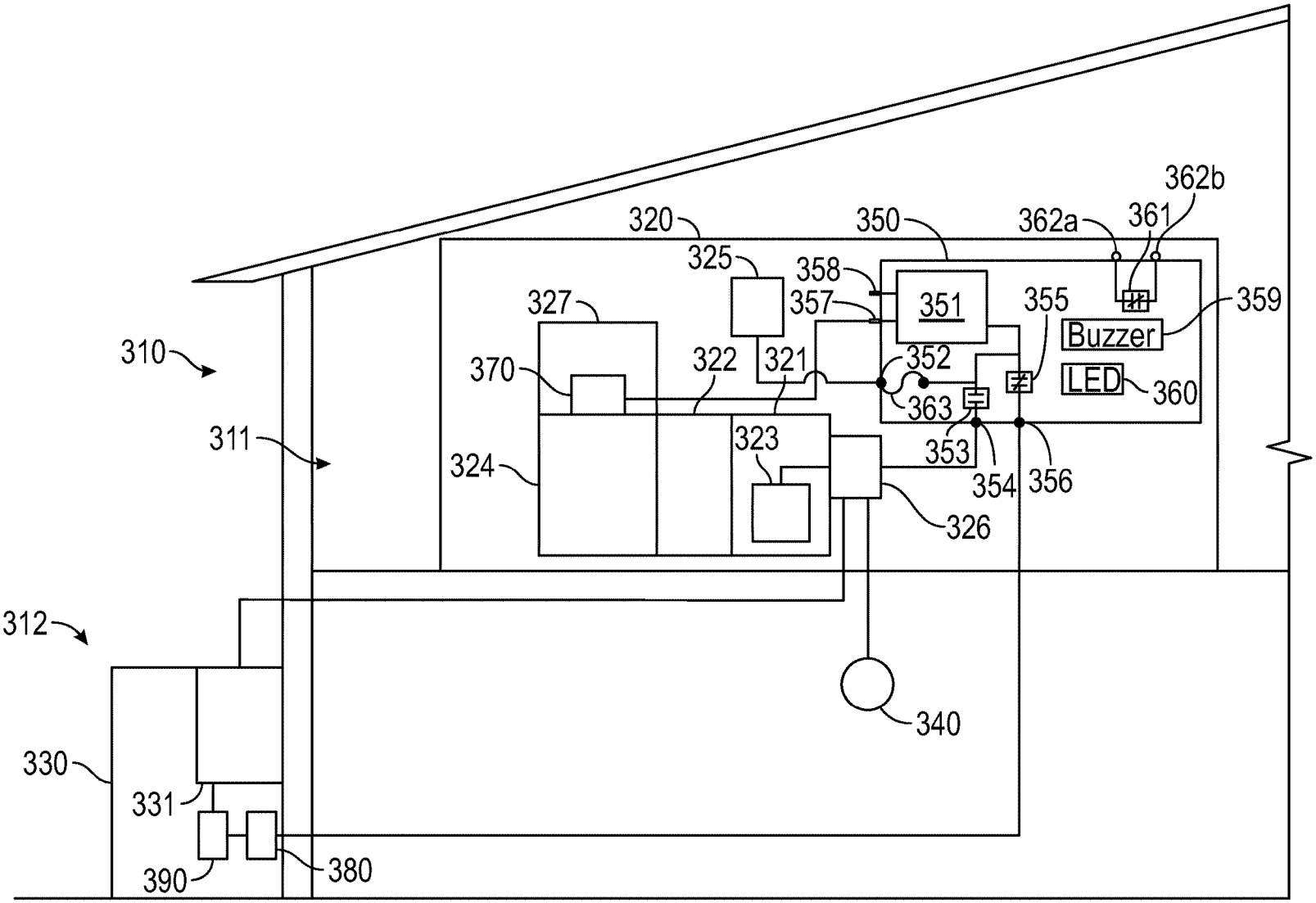
FIG. 3 shows a communicating HVAC system using an A2L refrigerant, according to one or more embodiments.

FIG. 3 shows a communicating HVAC system using an A2L refrigerant, according to a one or more embodiments. In one or more embodiments, an HVAC system 300 may be used to distribute cooled or heated air throughout a building 310 to adjust the ambient air temperature inside 311 of the building 310. The HVAC system may include an indoor unit 320, an outdoor unit 330, a thermostat 340, an A2L control board 350, an A2L sensor 370, an outdoor relay 380, and a high pressure switch 390.

Generally, in one or more embodiments, the indoor unit 320 may be fluidly coupled to the outdoor unit 330 such that an A2L refrigerant may flow between the indoor unit 320 and the outdoor unit 330 to cool or heat air within the indoor unit 320. Further, in one or more embodiments, both the indoor unit 320 and the outdoor unit 330 may be communicatively coupled to each other by way of an RS-485 system communication. The thermostat 340 may be either a non-communicating or communicating thermostat and may be electrically coupled to the indoor unit 320 either by a 24 volt A/C connection or an R-485 system communication. Furthermore, in one or more embodiments, the A2L control board 350 may be directly electrically coupled to the indoor unit 320 and indirectly electrically coupled to the outdoor unit 330 by way of the outdoor relay 380 and the high pressure switch 390. The A2L control board 350 may act as a passthrough for power to the indoor unit 320 and may be configured to block power from getting to certain parts of the indoor unit 320 if there is an A2L refrigerant leak in the system. Additionally, the A2L control board 350 may be configured to turn off the outdoor unit by way of electrical connections between the A2L control board 350, the outdoor relay 380, the high pressure switch 390, and the outdoor unit 320. Further, the A2L sensor 370 may be physically disposed within the indoor unit 320 and electrically coupled to the A2L control board 350. The A2L sensor 370 may be configured to send signals to the A2L control board 350 when an A2L refrigerant leak is detected.

In one or more embodiments, indoor unit 320 may be disposed on the inside 311 of the building 310. The indoor unit 320 may be configured to distribute cooled or heated air to rooms on the inside 311 of the building 310. The indoor unit 320 may be any type of HVAC system that includes a blower 321 and a heat exchanger 327 having an indoor evaporator coil 324. Thus, in one or more embodiments, the indoor unit 320 may be either a furnace or an air handler, as both types of system include, at least, a blower and an indoor evaporator coil. Additionally, the indoor evaporator coil 324 may be disposed adjacent to the blower 321, such that when the blower 321 blows air within the indoor unit 320, the air is blown through the evaporator coil 324.

Further, in one or more embodiments, the blower 321 may include a blower fan 322 and a blower motor 323. By way of example, in one or more embodiments, the blower motor 323 may be constant torque motor, while in other embodiments, the blower motor 323 may be a permanent split capacitor (PSC) motor. The blower motor 323 may be mechanically coupled to the blower fan 322 such that when the blower motor 323 is turned on, the blower fan 322 is configured to spin and cause a movement of air out from the blower 321 and through the indoor evaporator coil 324. The indoor evaporator coil 324 may be configured to receive the A2L refrigerant on the inside of the coil while air from the blower 321 is blown across the outside of the coil, which allows for heat to exchange either from the A2L refrigerant to the air or vice versa. The A2L refrigerant, after cooling or heating the air, may be cycled back to the outdoor unit 330, where it will go through the reverse heat exchange process before returning to the indoor evaporator coil 324. Additionally, indoor unit 320 is configured to distribute the air that is blown from the blower 321 and across the indoor evaporator coil 324 to the rooms on the inside 311 of the building 310 by way of the force of the blower 321.

The indoor unit 320 may also include a transformer 325 and an indoor control board 326. The transformer 325 may be directly electrically coupled to and configured to provide 24 volts A/C power to the A2L control board 350. Further, the indoor control board 326 may be electrically coupled to the A2L control board 350 such that the indoor control board 326 may receive 24 volts A/C power indirectly from the transformer 325. Additionally, the indoor control board 326 may be electrically coupled to, at least, the blower motor 323 and the thermostat 340. In one or more embodiments, the transformer 325 may be configured to indirectly provide a 24 volt A/C power to the blower motor 323 by way of the indoor control board 326 and the A2L control board 350. In one or more embodiments, the blower motor has its own source of power. So, while the 24 volt A/C power that the blower motor receives does not power on the blower motor 323, the 24 volt A/C signal is needed to turn the blower motor 323 on. Further, the indoor control board 326 may be electrically coupled to the thermostat by either a 24 volt A/C power connection or by an R-485 system communication depending on whether the thermostat is a non-communicating or communicating thermostat, respectively.

Further, the outdoor unit 330 may be disposed on an outside 312 of the building 310 and be configured to use the outdoor environment to reheat or cool down the A2L refrigerant after it has been run through the indoor evaporator coil 324. The outdoor unit 330 may include, but is not limited to, either a heat pump or an air conditioner. Whether the outdoor unit 330 is a heat pump or an air conditioner, the outdoor unit 330 may include a compressor (not shown), an outdoor coil (not shown), and an outdoor control board 331. The outdoor unit 330 may be configured to communicate with the indoor unit 320 through RS-485 system communication between the indoor control board 326 and the outdoor control board 331. Further, the outdoor control board 331 may be electrically coupled to the A2L control board 350 as discussed below.

Still referring to FIG. 3, in one or more embodiments, the A2L sensor 370 may be configured to detect an A2L refrigerant leak and send a signal reporting as much. In one or more embodiments, the A2L sensor 370 may be configured to detect an A2L refrigerant leak by one of a number of methods, including, at least, by detecting an amount or a concentration of A2L refrigerant in the air that exceeds a leak threshold. The A2L sensor 370 may be electrically coupled to and communicate with the A2L control board 350. In one or more embodiments, the A2L sensor 370 may be electrically coupled to the A2L control board 350 by way of a first sensor connector 357. The A2L sensor 370 may be configured to communicate to the A2L control board 350 that the A2L sensor 370 is connected to the system and working properly. Additionally, when the A2L sensor 370 detects an A2L refrigerant leak, it may communicate the A2L refrigerant leak to the A2L control board 350, which may be configured to receive the signal and perform the safety measures required by A2L safety standards. In one or more embodiments, the A2L sensor 370 and the A2L control board 350 may be electrically coupled by way of an RS-485 bus; however, one of ordinary skill in the art would understand that any type of electrical connection that allows the A2L sensor 370 to send a signal to the A2L control board 350 may be used.

While the A2L sensor 370 is depicted as being electrically and communicatively coupled to the A2L control board 350 by way of a wired connection, one of ordinary skill in the art would understand that the A2L sensor 370 may just be communicatively coupled to the A2L control board 350 wirelessly. In one or more embodiments, the A2L sensor 370 may be communicatively coupled to the A2L control board 350 by any wireless means, such as Wi-Fi or Bluetooth.

Further, in one or more embodiments, the A2L sensor 370 may be disposed within the indoor unit 320 so that it may detect an A2L refrigerant leak that occurs within the indoor evaporator coil 324 of the HVAC system 300. As depicted, in one or more embodiments, the A2L sensor 370 may be disposed directly against the indoor evaporator coil to minimize the time it takes for the A2L sensor 370 to detect an A2L refrigerant leak. Further, while the A2L sensor 370 is depicted within the indoor unit 320, one or ordinary skill in the art would understand that the A2L sensor 370 may instead be disposed within the outdoor unit 330. Further, while a single sensor is depicted, one of ordinary skill in the art would understand that multiple sensors may be incorporated into the HVAC system to ensure that an A2L refrigerant leak is detected and the required safety measures are taken within the time required by A2L safety standards. For example, one of ordinary skill in the art would understand that the HVAC system may include two A2L sensors, with both A2L sensors disposed within the indoor unit, both A2L sensors disposed within the outdoor unit, or one A2L sensor disposed within each of the indoor unit and the outdoor unit. Thus, one of ordinary skill in the art would understand that in one or more embodiments, a plurality of A2L sensors may be disposed within the HVAC system with one or more A2L sensors disposed within the indoor unit and/or one or more A2L sensors disposed within the outdoor unit as may be determined necessary to ensure that an A2L refrigerant leak is detected and the required safety measures are taken within the time required by A2L safety standards.

Additionally, referring to FIG. 3, in one or more embodiments, the A2L control board 350 may be disposed inside of the indoor unit 320. However, one of ordinary skill in the art would understand that, in one or more embodiments, the A2L control board 350 may be disposed outside of the indoor unit 320 and either connected to the indoor unit 320 or adjacent to the indoor unit 320. Further, in addition to being electrically coupled to the transformer 325, the indoor control board 326, and the A2L sensor 370, as discussed above, the A2L control board 350 may be electrically coupled to the outdoor control board 331 by way of the outdoor relay 380 and the high pressure switch 390. In one or more embodiments, the outdoor relay 380 and the high pressure switch 390 may be electrically coupled in series between the A2L control board 350 and the outdoor control board 331. In one or more embodiments, the outdoor relay 380 may be directly electrically coupled to the A2L control board 350 such that the outdoor relay 380 is configured to open upon receiving a 24 volt A/C power signal from the A2L control board 350. Further, in one or more embodiments, the high pressure switch 390 is electrically coupled to the outdoor control board 331 such that when the high pressure switch 390 opens, the outdoor unit 330 shuts down completely. Furthermore, in one or more embodiments, opening the outdoor relay 380 causes the high pressure switch 390 to open, which causes the outdoor unit 330 to shut down completely.

In one or more embodiments, the A2L control board 350 may include a power supply 351, a power-in contact point 352, a first relay 353, a first power-out contact point 354, a second relay 355, a second power-out contact point 356, a first sensor connector 357, a second sensor connector 358, a buzzer 359, an LED 360, a dry contact relay 361, first and second ventilator contact points 362*a* and 362*b*, and a fuse 363. The power supply 351 may be coupled to circuitry on the A2L control board 350 such that the A2L control board may open and close, at least, the first relay 353, the second relay 354, and the dry contact relay 361. Further, in one or more embodiments, the first relay 353 may be electrically disposed between the power-in contact point 352 and the first power-out contact point 354, such that when the first relay 353 is open, power from the power-in contact point 352 does not reach the first power-out contact point 354. Furthermore, the fuse 363 may be electrically disposed between the power-in contact point 352 and the first relay 353. Similarly, in one or more embodiments, the second relay 355 may be electrically disposed between the power-in contact point 352 and the second power-out contact point 356, such that when the second relay 355 is open, power from the power-in contact point 352 does not reach the second power-out contact point 356. Additionally, the fuse 363 may be electrically disposed between the power-in contact point 352 and the second relay 355. By way of example, in one or more embodiments, when the first relay 353 is open, the second relay 355 is closed, and when the second relay 355 is open, the first relay 353 is closed. Further, in one or more embodiments, in the default state, the first relay 353 is open and the second relay 355 is closed.

In one or more embodiments, the transformer 325 may be electrically coupled to the power-in contact point 352, the first power-out contact point 354 may be electrically coupled to the indoor control board 326, and the second power-out contact point 356 may be electrically coupled to outdoor relay 380. FIG. 3 displays a default state of the A2L control board 350, where the 24 volt A/C power coming from the transformer 325 is routed to the outdoor relay 380. Further, in one or more embodiments, if the A2L control board 350 fails, the relays all revert to their default state, and thus, if the A2L control board 350 fails, power will be directed to the outdoor relay 380, causing it to open, thus opening the high pressure switch 390 and shutting off the outdoor unit 330. Furthermore, in one or more embodiments, when the A2L control board 150 is turned on, the second relay 154 immediately opens so that power is not unnecessarily run to the outdoor relay 380 before necessary. Additionally, after the A2L control board 350 is turned on, when the system is ready to run, the first relay 352 is closed, turning on the HVAC system 300.

Further, in one or more embodiments, the power supply 351 may be coupled to the first sensor connector 357 and the second sensor connector 358, separately. Thus, in one or more embodiments, the A2L control board 350 may separately test one or more A2L sensors 370 before closing the first relay 353 and powering up the HVAC system 300. This allows for the A2L control board 350 to make sure that the sensors 370 are working properly and there are no A2L refrigerant leaks before beginning the system. While two separate sensor connectors are depicted, one of ordinary skill in the art would understand that the A2L control board may instead include a sensor signal-in contact and a sensor signal-out contact and the one or more sensors may be run in series instead of in parallel.

Thus, when the A2L control board 350 receives a signal from the A2L sensor 370 that there is an A2L refrigerant leak, the A2L control board 350 may be configured to carry out the required safety measures required by A2L safety standards. More specifically, in one or more embodiments, if a leak is detected, the A2L control board 350 may be configured to cut off power to the indoor control board 326 by opening the first relay 353, while directing power directly to the outdoor relay 380 by closing the second relay 355. Since the indoor unit 320 receives power from the indoor control board 326, when the A2L sensor detects an A2L refrigerant leak and the A2L control board 350 cuts power to the indoor control board 326, the indoor unit 320 is configured to lose power and shut off. Further, in one or more embodiments, the blower motor 323 may be configured such that if the blower motor 323 loses signal from the indoor control board 326, the blower motor 323 turns on and stays on. Thus, when the A2L control board 350 removes power from the indoor control board 326 in response to a detected A2L refrigerant leak, the blower motor 323 will lose a signal from the indoor control board 326 and turn on. Further, closing the second relay 355 in response to an A2L refrigerant leak being detected causes power to be diverted directly to the outdoor relay 380. Furthermore, in one or more embodiments, power being diverted directly to the outdoor relay 380 causes the outdoor relay 380 to open. Moreover, opening the outdoor relay 380 is configured to cause the high pressure switch 390 to open. Additionally, the outdoor unit 330 is configured to shut down completely if the high pressure switch 390 is opened. Thus, opening the second relay 355 is configured to shut down the outdoor unit 330 completely. This allows the HVAC system 300 to meet the A2L safety requirements within the requisite time after detection of an A2L refrigerant leak.

While FIG. 3 depicts one or more embodiments of the present invention that utilize an outdoor relay 380 and a high pressure switch 390 in order to shut off the outdoor unit in the event of an A2L refrigerant leak, one of ordinary skill in the art would understand that any means of turning off the compressor of the outdoor unit would work to properly meet the A2L safety requirements. By way of example, in one or more embodiments, the HVAC system may include an A2L control board that is electrically coupled to a contactor, where the contactor is configured to contact the outdoor control board such that the outdoor unit shuts off in the event of an A2L refrigerant leak being detected. Further, in other embodiments, the A2L control board may be communicatively coupled to the outdoor control board by way of an RS-485 system communication such that the A2L control board can tell the outdoor control board to shut down the outdoor unit in the event of an A2L leak being detected. Furthermore, in one or more embodiments, the A2L control board may be electrically coupled to a relay, where the relay is disposed between the outdoor control board and the compressor of the outdoor unit such that when the relay is opened, power from the outdoor control board does not reach the compressor, and the compressor shuts down.

Further, while in one or more embodiments a 24 volt A/C signal is used by the A2L control board to communicate with the outdoor relay to shut down the outdoor unit, one of ordinary skill in the art would understand that, in one or more embodiments, the A2L control board may send digital signals to the outdoor relay. One of ordinary skill in the art would understand that digital signals may also be used with a contactor or any other relay coupled to the outdoor control board to shut down the outdoor unit. Furthermore, in one or more embodiments, the A2L control board may be wirelessly, communicatively coupled to the outdoor control board such that wireless signals may be used to turn off the outdoor unit.

Additionally, as discussed above, in one or more embodiments, the A2L control board 350 may include a buzzer 359, an LED 360, a dry contact relay 361, and first and second ventilator contact points 362*a* and 362*b*. In one or more embodiments, the dry contact relay 361 may be electrically coupled to a ventilator (not shown), such that when the A2L control board 350 receives an A2L refrigerant leak signal from the A2L sensor 370, the dry contact relay 361 will flip and turn on the ventilator. Furthermore, in one or more embodiments, when the A2L control board receives an A2L refrigerant leak signal from the A2L sensor, the LED 360 and the buzzer 359 will receive power. When receiving power, the LED 360 will display an error code and the buzzer 359 will make sound in order to give visual and auditory alarms that the HVAC system 300 is experiencing an A2L refrigerant leak.

Figure 4:
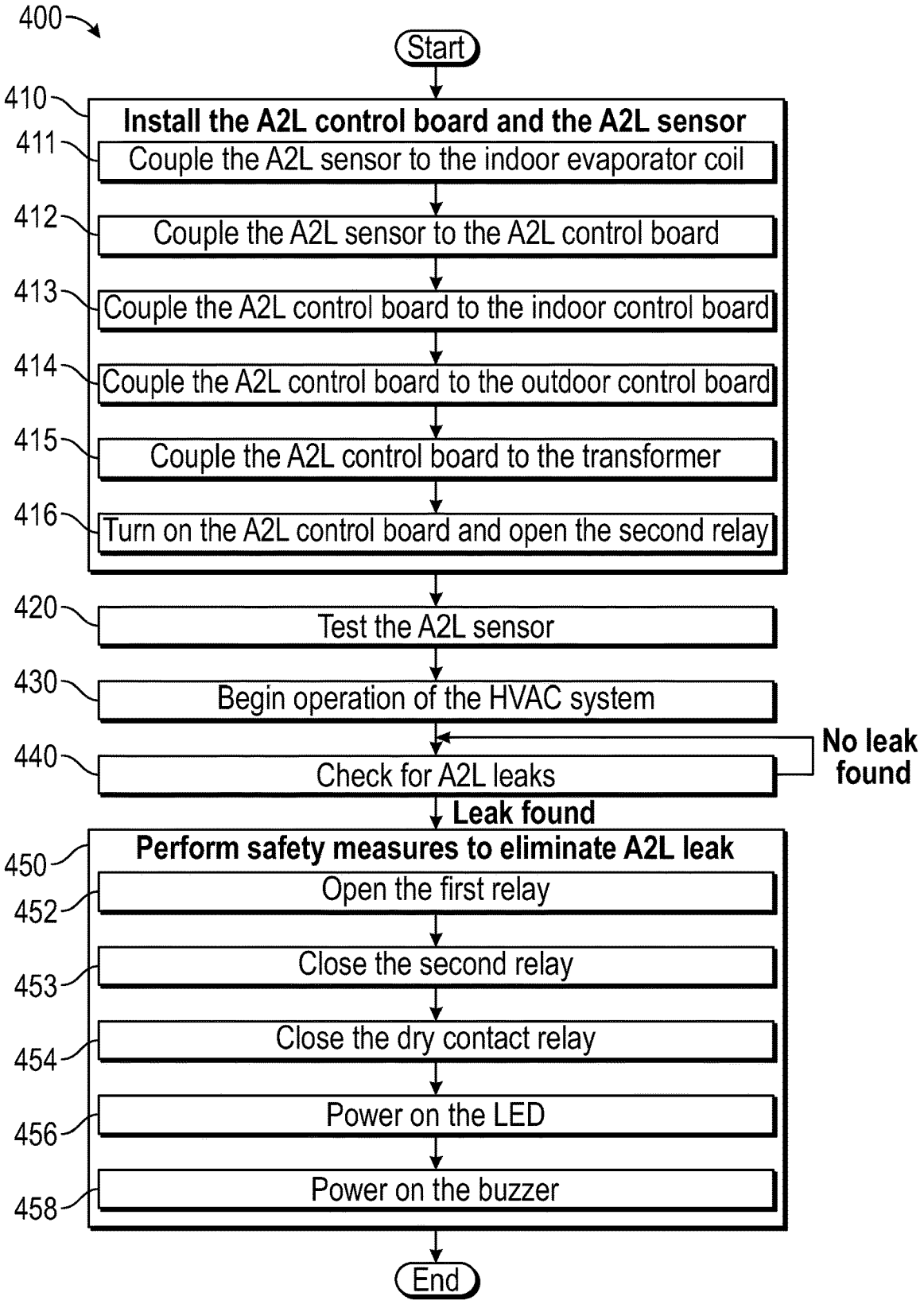
FIG. 4 is a flow chart illustrating an embodiment of a method of operating a communicating HVAC system using an A2L refrigerant, according to one or more embodiments.

Referring now to FIG. 4, a flow chart of an embodiment of a method 400 of installing and operating a communicating HVAC system using an A2L refrigerant as described above with respect to FIG. 3, according to one or more embodiments, is illustrated. Beginning with an HVAC system 300 in which the indoor unit 320 has been disposed on an inside 311 of a building 310, the outdoor unit 330 has been disposed on an outside 312 of the building 310, the indoor control board 326 has been electrically coupled to the thermostat 340 and a blower motor 323 of the blower 321, and the outdoor control board 331 has been communicatively coupled to the indoor control board 326, the method 400 may include one or more of the following: (step 410) installing the A2L control board 350 and the A2L sensor 370 into the HVAC system 300, (step 420) testing the A2L sensor 370, (step 430) beginning operation of the HVAC system 300, (step 440) checking for A2L refrigerant leaks, and (step 450) performing safety measures upon detecting an A2L refrigerant leak.

At step 410, an A2L control board 350 and an A2L sensor 370 may be installed into the HVAC system 300. Installation of the A2L control board 350 and the A2L sensor 370 may include, at least, (step 411) physically coupling the A2L sensor 370 to the indoor evaporator coil 324 of the indoor unit 320, (step 412) electrically coupling the A2L sensor 370 to the A2L control board 350, (step 413) electrically coupling the A2L control board 350 to the indoor control board 326, (step 414) electrically coupling the A2L control board 350 to outdoor control board 331, (step 415) electrically coupling the A2L control board 350 to the transformer 325, and (step 416) turning on the A2L control board 150 and opening the second relay 155.

In one or more embodiments, at step 411, the A2L sensor 370 may be disposed within the indoor unit 320 such that it is adjacent or connected to the indoor evaporator coil 324 such that the A2L sensor 370 is able to detect an A2L refrigerant leak if one occurs. Further, at step 412, the A2L sensor 370 may be electrically coupled to the A2L control board 350 such that the A2L sensor 370 and the A2L control board 350 have two-way communication between them. By way of example, in one or more embodiments, an A2L sensor 370 may be electrically coupled to a first sensor connector 357 of the A2L control board 350 by way of an RS-485 bus. One of ordinary skill in the art would appreciate that in other embodiments, any other electric coupling that allows for two-way communication between the A2L sensor 370 and the A2L control board 350 may be used.

At step 413, the A2L control board 350 may be electrically coupled to the indoor control board 326. In one or more embodiments, a wire capable of carrying 24 volt A/C power may be electrically coupled on one end to a power-in terminal within the indoor control board 326 and on the other end to a first power-out contact 354 of the A2L control board 350. Thus, once a transformer 325 is electrically coupled to the A2L control board 350, providing a 24 volt A/C power to the A2L control board 350, and a first relay 353 is closed, the indoor control board 326 may receive the 24 volt A/C power.

At step 414, the A2L control board 350 may be electrically coupled to the outdoor control board 331. In one or more embodiments, the high pressure switch 390 may be electrically coupled to the outdoor control board 331 such that when the high pressure switch 390 opens, the outdoor control board 331 shuts down. Further, the outdoor relay 380 may be electrically coupled to the high pressure switch 390 such that when the outdoor relay opens, the high pressure switch opens. Furthermore, the outdoor relay 380 may be electrically coupled to a second power-out contact 356 of the A2L control board 350 by way of a wire capable of carrying 24 volt A/C power. Thus, once a transformer 325 is electrically coupled to the A2L control board 350, providing a 24 volt A/C power to the A2L control board 350, closing the second relay 355 causes the outdoor relay 380 to open, which causes the high pressure switch 390 to open, which causes the outdoor control board 331 to shut down the outdoor unit 330. In one or more embodiments, the default for the second relay 355 may be that it is closed; however, while the HVAC system is running and no A2L leak is detected, the second relay 355 is kept open. Further, in the event that an A2L refrigerant leak is detected, the second relay 355 is closed which causes the outdoor unit 330 to shut down completely.

At step 415, the A2L control board 350 may be electrically coupled to the transformer 325. In one or more embodiments, a wire capable of carrying 24 volt A/C power may be electrically coupled on one end to a power-out terminal within the transformer 325 and on the other end to a power-in contact 352 of the A2L control board 350. Thus, once the transformer 325 is electrically coupled to the A2L control board 350, the A2L control board has a 24 volt A/C power that it may distribute to either the indoor control board 326 or the outdoor relay 380.

At step 416, the A2L control board 350 may be turned on and the second relay 355 may be opened. In one or more embodiments, when the A2L control board 350 is turned on, the relays are in the default state, which includes the second relay 355 being closed. Thus, in order to make sure power is not unnecessarily diverted to the blower motor 323, in one or more embodiments, when the A2L control board 350 powers up, the A2L control board 350 opens the second relay 355.

At step 420, the A2L sensor 370 may be tested to confirm that it is properly operational. Once electrically coupled to the A2L control board 350, in one or more embodiments, the A2L sensor 370 may perform an internal diagnostic check to make sure that the sensor is operating properly and may detect an A2L refrigerant leak. If the diagnostic check is successful, the A2L sensor 370 may communicate the successful diagnostic check to the A2L control board 350, which can begin operation of the HVAC system 300. If the A2L sensor 370 fails the diagnostic check, the A2L sensor 370 will communicate the failed diagnostic check to the A2L control board 350, which will remain in the default configuration, keeping the HVAC system 300 from operating until the A2L sensor is repaired or replaced.

At step 430, the A2L control board 350 may begin operation of the HVAC system 300. In order to begin operation, in one or more embodiments, the A2L control board 350 may close the first relay 353 of the A2L control board 350. Closing the first relay 353 allows for the 24 volt A/C power that the A2L control board 350 receives from the transformer 325 to pass to the indoor control board 326 and power up the indoor unit 320.

At step 440, while the HVAC system is running, in one or more embodiments, the A2L sensor 370 may check for A2L refrigerant leaks. The A2L sensor 370 may continuously check for A2L refrigerant leaks while the HVAC system 300 is running, such that if a check comes back negative for an A2L refrigerant leak, the A2L sensor 370 repeats step 440. However, if the AL2 sensor 370 detects an A2L leak, then the A2L sensor 370 communicates the A2L refrigerant leak to the A2L control board and the HVAC system continues to step 450.

At step 450, the HVAC system 300, by way of the A2L control board 350, may perform safety measures to eliminate the threat of the detected A2L refrigerant leak. Specifically, the HVAC system 300 may (step 452) open the first relay 353, (step 453) close the second relay 355, (step 454) close the dry contact relay 361, (step 456) power on the LED 360, and (step 458) power on the buzzer 359. At step 452, opening the first relay 353 prevents the 24 volt A/C power that the A2L control board 350 receives from the transformer 325 from passing to the indoor control board 326, thus removing the 24 volt A/C power from the indoor unit 320. As discussed above, removing the power from the indoor unit 320 causes the blower motor 323 to lose its signal from the indoors control board 326 such, which causes the blower motor 323 to turn on and remain on. Additionally, at step 453, closing the second relay 355 causes the 24 volt A/C power that the A2L control board 350 receives from the transformer 325 to pass to the outdoor relay 380. As discussed above, the 24 volt A/C power run directly to the outdoor relay 380 causes the outdoor relay 380 to open, which causes the high pressure switch 390 to open, which causes the outdoor control board 331 to turn off completely. Further, while listed as separate steps, one of ordinary skill would appreciate that in one or more embodiments, either step 452 or step 453 may take place before the other, or in other embodiments, step 452 and step 453 may occur simultaneously. Additionally, one of ordinary skill in the art would appreciate that both steps 452 and 453 may be completed within the requisite time after detection of an A2L refrigerant leak as required by A2L safety standards.

At step 454, in one or more embodiments, the A2L control board 350 may close the dry contact relay 361 that turns on a ventilator. In one or more embodiments, a ventilator may be connected to the HVAC system 300 by way of first and second ventilator contact points 362*a* and 362*b* on the A2L control board 350. Thus, when the A2L sensor 370 detects a leak, the A2L control board 350 may close the dry contact relay 361, which allows power to run directly to the ventilator and turns on the ventilator. Further, at step 456, when the A2L control board 350 receives the A2L refrigerant leak communication, the A2L control board 350 may provide power to the LED 360. Furthermore, at step 458, when the A2L control board 350 receives the A2L refrigerant leak communication, the A2L control board 350 may provide power to the buzzer 359.

Thus, in one or more embodiments, in response to a communication from the A2L sensor 370 that an A2L refrigerant leak has been detected, the A2L control board 350 may turn off the indoor unit 320 and the outdoor unit 330, except the blower motor 323, which is powered on by the loss of signal from the indoor control board 326, turn on a ventilator if the HVAC system 300 has one, and turn on visual and auditory alarms that an A2L refrigerant leak has been detected.

While the method 400 is described with respect to an HVAC system 300 including a single A2L sensor 370, one of ordinary skill in the art, would understand that any number of sensors may be used in the system and the method may include electrically coupling the further sensors to the control board, testing the further sensors, and communicating with the further sensors as the further sensors check for A2L refrigerant leaks.

Figure 5:
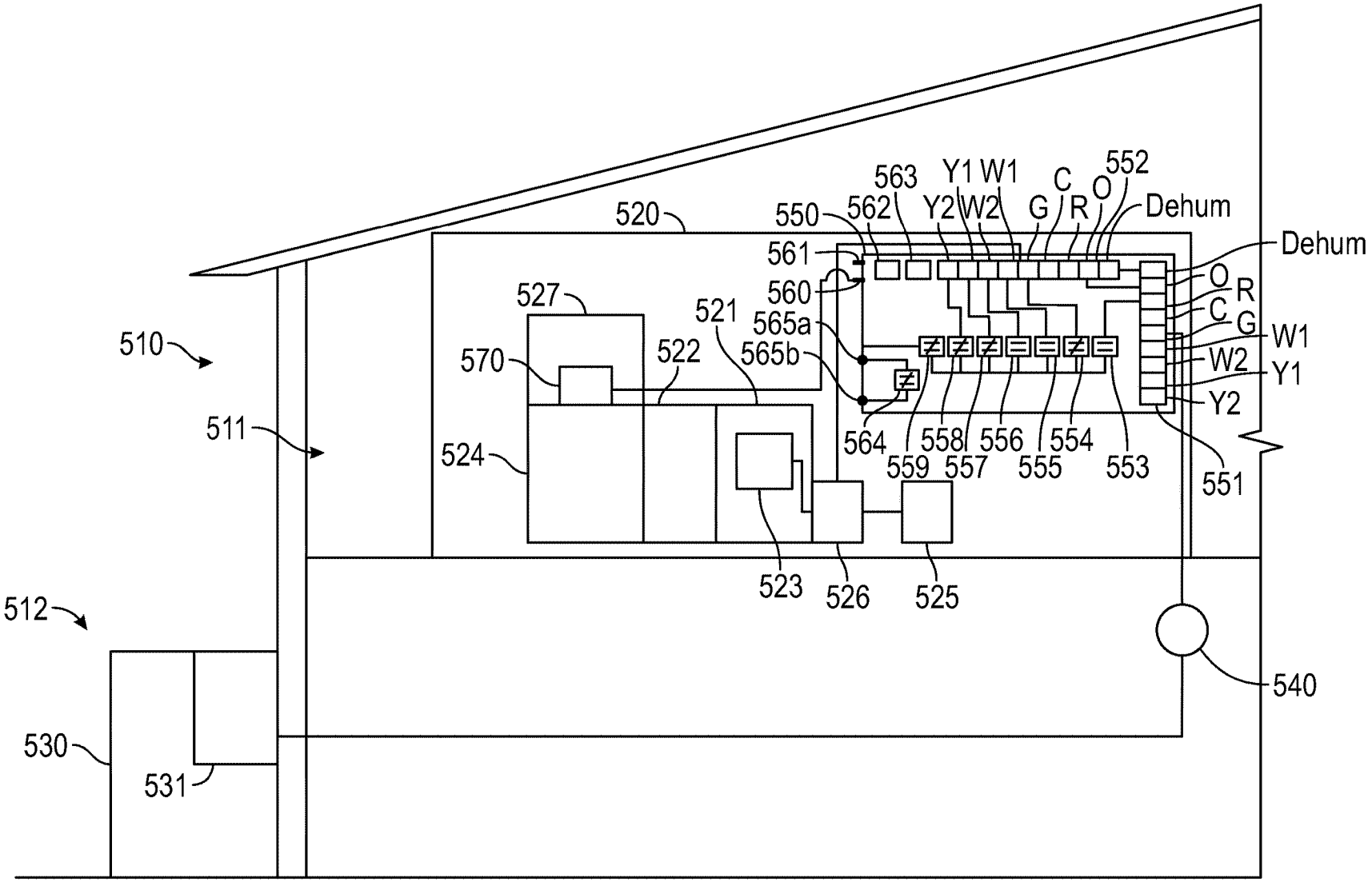
FIG. 5 shows another non-communicating HVAC system using an A2L refrigerant, according to a second embodiment.

FIG. 5 shows a non-communicating HVAC system using an A2L refrigerant, according to one or more embodiments. In one or more embodiments, an HVAC system 500 may be used to distribute cooled or heated air throughout a building 510 to adjust the ambient air temperature inside 511 of the building 510. The HVAC system may include an indoor unit 520, an outdoor unit 530, a thermostat 540, an A2L control board 550, and an A2L sensor 570. Generally, in one or more embodiments, the indoor unit 520 may be fluidly coupled to the outdoor unit 530 such that an A2L refrigerant may flow between the indoor unit 520 and the outdoor unit 530 to cool or heat air within the indoor unit 520. Further, in one or more embodiments, the indoor unit 520 may be indirectly electrically coupled to the thermostat 540, while the outdoor unit 530 may be directly electrically coupled to the thermostat 540. The thermostat 540 may be configured to use on/off-type signals for communication and control of the indoor unit 520 and the outdoor unit 530. Furthermore, in one or more embodiments, the A2L control board 550 may be directly electrically coupled between the indoor unit 520 and the thermostat 540, such that any communication or signals between the two must pass through the A2L control board 550. Thus, in one or more embodiments, the A2L control board 550 may act as a passthrough for power to portions of the indoor unit 520, the outdoor unit 530, and the thermostat 540 and may be configured to block power from getting to certain parts of the indoor unit 520, the outdoor unit 530, and the thermostat 540 if there is an A2L refrigerant leak in the system. Additionally, an A2L sensor 570 may be physically disposed within the indoor unit 520 and electrically coupled to the A2L control board 550. The A2L sensor 570 may be configured to send signals to the A2L control board 550 when an A2L refrigerant leak is detected.

In one or more embodiments, indoor unit 520 may be disposed on the inside 511 of the building 510. The indoor unit 520 may be configured to distribute cooled or heated air to rooms on the inside 511 of the building 510. The indoor unit 520 may be any type of HVAC system that includes a blower 521 and a heat exchanger 527 having an indoor evaporator coil 524. Thus, in one or more embodiments, the indoor unit 520 may be either a furnace or an air handler, as both types of system include, at least, a blower and an indoor evaporator coil. Additionally, the indoor evaporator coil 524 may be disposed adjacent to the blower 521, such that when the blower 521 blows air within the indoor unit 520, the air is blown through the evaporator coil 524.

Further, in one or more embodiments, the blower 521 may include a blower fan 522 and a blower motor 523. By way of example, in one or more embodiments, the blower motor 523 may be constant torque motor, while in other embodiments, the blower motor 523 may be a permanent split capacitor (PSC) motor. The blower motor 523 may be mechanically coupled to the blower fan 522 such that when the blower motor 523 is turned on, the blower fan 522 is configured to spin and cause a movement of air out from the blower 521 and through the indoor evaporator coil 524. The indoor evaporator coil 524 may be configured to receive the A2L refrigerant on the inside of the coil while air from the blower 521 is blown across the outside of the coil, which allows for heat to exchange either from the A2L refrigerant to the air or vice versa. The A2L refrigerant, after cooling or heating the air, may be cycled back to the outdoor unit 530, where it will go through the reverse heat exchange process before returning to the indoor evaporator coil 524. Additionally, indoor unit 520 is configured to distribute the air that is blown from the blower 521 and across the indoor evaporator coil 524 to the rooms on the inside 511 of the building 510 by way of the force of the blower 521.

The indoor unit 520 may also include a transformer 525 and an indoor control board 526. The transformer 525 may be directly electrically coupled to and configured to provide 24 volts A/C power to the indoor control board 526. Further, the indoor control board 526 may be electrically coupled to, at least, the A2L control board 550 and the blower motor 523.

Further, the outdoor unit 530 may be disposed on an outside 512 of the building 510 and be configured to use the outdoor environment to reheat or cool down the A2L refrigerant after it has been run through the indoor evaporator coil 524. The outdoor unit 530 may include, but is not limited to, either a heat pump or an air conditioner. Whether the outdoor unit 530 is a heat pump or an air conditioner, the outdoor unit 530 may include a compressor (not shown), an outdoor coil (not shown), and an outdoor control board 531. The outdoor unit 530 may be configured to receive power through the outdoor control board 531, which itself is configured to receive power from the transformer 525 by way of the thermostat 540, the indoor control board 526, and the A2L control board 550. By way of example only, in one or more embodiments, the outdoor control board 531 may be configured to receive power and control signals from the thermostat 540, such that outdoor control board 531 may start the condenser after receiving a signal from the thermostat 540 to do so.

Still referring to FIG. 5, in one or more embodiments, the A2L sensor 570 may be configured to detect an A2L refrigerant leak and send a signal reporting as much. In one or more embodiments, the A2L sensor 570 may be configured to detect an A2L refrigerant leak by one of a number of methods, including, at least, by detecting an amount or a concentration of A2L refrigerant in the air that exceeds a leak threshold. The A2L sensor 570 may be electrically coupled to and communicate with the A2L control board 550. In one or more embodiments, the A2L sensor 570 may be electrically coupled to the A2L control board 550 by way of a first sensor connector 560. The A2L sensor 570 may be configured to communicate to the A2L control board 550 that the A2L sensor 570 is connected to the system and working properly. Additionally, when the A2L sensor 570 detects an A2L refrigerant leak, it may communicate the A2L refrigerant leak to the A2L control board 550, which may be configured to receive the signal and perform the safety measures required by A2L safety standards. In one or more embodiments, the A2L sensor 570 and the A2L control board 550 may be electrically coupled by way of an RS-485 bus; however, one of ordinary skill in the art would understand that any type of electrical connection that allows the A2L sensor 570 to send a signal to the A2L control board 550 may be used.

While the A2L sensor 570 is depicted as being electrically and communicatively coupled to the A2L control board 550 by way of a wired connection, one of ordinary skill in the art would understand that the A2L sensor 570 may just be communicatively coupled to the A2L control board 550 wirelessly. In one or more embodiments, the A2L sensor 570 may be communicatively coupled to the A2L control board 550 by any wireless means, such as Wi-Fi or Bluetooth.

Further, in one or more embodiments, the A2L sensor 570 may be disposed within the indoor unit 520 so that it may detect an A2L refrigerant leak that occurs within the indoor evaporator coil 524 of the HVAC system 500. As depicted, in one or more embodiments, the A2L sensor 570 may be disposed directly against the indoor evaporator coil to minimize the time it takes for the A2L sensor 570 to detect an A2L refrigerant leak. Further, while the A2L sensor 570 is depicted within the indoor unit 520, one or ordinary skill in the art would understand that the A2L sensor 570 may instead be disposed within the outdoor unit 530. Further, while a single sensor is depicted, one of ordinary skill in the art would understand that multiple sensors may be incorporated into the HVAC system to ensure that an A2L refrigerant leak is detected and the required safety measures are taken within the time required by A2L safety standards. For example, one of ordinary skill in the art would understand that the HVAC system may include two A2L sensors, with both A2L sensors disposed within the indoor unit, both A2L sensors disposed within the outdoor unit, or one A2L sensor disposed within each of the indoor unit and the outdoor unit. Thus, one of ordinary skill in the art would understand that in one or more embodiments, a plurality of A2L sensors may be disposed within the HVAC system with one or more A2L sensors disposed within the indoor unit and/or one or more A2L sensors disposed within the outdoor unit as may be determined necessary to ensure that an A2L refrigerant leak is detected and the required safety measures are taken within the time required by A2L safety standards.

Additionally, referring to FIG. 5, in one or more embodiments, the A2L control board 550 may be disposed inside of the indoor unit 520. However, one of ordinary skill in the art would understand that, in one or more embodiments, the A2L control board 550 may be disposed outside of the indoor unit 520 and either connected to the indoor unit 520 or adjacent to the indoor unit 520. Further, as discussed above, the A2L control board 550 may be electrically coupled to the indoor control board 526, the thermostat 540, and the A2L sensor 570.

In one or more embodiments, the A2L control board 550 may include a power supply (not shown), a first terminal block 551, a second terminal block 552, an R wire relay 553, an G wire relay 554, a W1 wire relay 555, a W2 wire relay 556, a Y1 wire relay 557, a Y2 wire relay 558, an alarm relay 559, a first sensor connector 560, a second sensor connector 561, a buzzer 562, an LED 563, a dry contact relay 564, and first and second ventilator contact points 565*a* and 565*b*. The power supply may be coupled to circuitry on the A2L control board 550 such that the A2L control board may open and close, at least, the R wire relay 553, the G wire relay 554, the W1 wire relay 555, the W2 wire relay 556, the Y1 wire relay 557, the Y2 wire relay 558, the alarm relay 559, and the dry contact relay 564.

In one or more embodiments, the thermostat 540 may be electrically coupled to the first terminal block 551, and the indoor control board 526 may be electrically coupled to the second terminal block 552. Further, in one or more embodiments, any signals received by the A2L control board 550 from the thermostat 540 may be passed unchanged, by the A2L control board 550, to the indoor control board 530 through the second terminal block 552.

In one or more embodiments, the R wire relay 553 may be electrically disposed between the power supply and the R wire connection of the first terminal block 551. Thus, when the R wire relay 553 is closed, 24 volt A/C power may be delivered from the A2L control board 550 to the thermostat 540 via the first terminal block 551, which powers the thermostat 540 on. Further, when the R wire relay 553 is open, no power is able to reach the thermostat, and thus, the thermostat and, indirectly, the outdoor unit 530 are turned off completely. Additionally, as depicted in FIG. 5, in one or more embodiments, the default state for the R wire relay 553 is to be open.

In one or more embodiments, the G wire relay 554 may be electrically disposed between the power supply and the G wire connection of the second terminal block 552. Thus, when the G wire relay 554 is closed, 24 volt A/C power may be delivered from the A2L control board 550 to the indoor control board 526 via the first terminal block 551, which signals the indoor control board 526 to power the blower motor 523 on. Further, when the G wire relay 554 is open, no signal is sent along the G wire to the indoor control board 526, and thus, the blower motor 523 is powered off. Additionally, as depicted in FIG. 5, in one or more embodiments, the default state for the G wire relay 554 is to be closed.

In one or more embodiments, the W1 wire relay 555 may be electrically disposed between the power supply and the W1 wire connection of the second terminal block 552, and the W2 wire relay 556 may be electrically disposed between the power supply and the W2 wire connection of the second terminal block 552. Thus, when the W1 wire relay 555 and the W2 wire relay 556 are closed, 24 volt A/C power may be delivered from the A2L control board 550 to the indoor control board 526 via the first terminal block 551, which signals the indoor control board 526 to run the heating system's first and second stages, respectively. Further, when the W1 wire relay 555 and W2 wire relay 556 are open, no signal is sent along the W1 or W2 wires to the indoor control board 526, and thus, the heating system is powered off. Additionally, as depicted in FIG. 5, in one or more embodiments, the default states for the W1 wire relay 555 and the W2 wire relay 556 are to be open.

In one or more embodiments, the Y1 wire relay 557 may be electrically disposed between the power supply and the Y1 wire connection of the second terminal block 552, and the Y2 wire relay 558 may be electrically disposed between the power supply and the Y2 wire connection of the second terminal block 552. Thus, when the Y1 wire relay 557 and the Y2 wire relay 558 are closed, 24 volt A/C power may be delivered from the A2L control board 550 to the indoor control board 526 via the first terminal block 551, which signals the indoor control board 526 to run the cooling system's first and second stages, respectively. Further, when the Y1 wire relay 557 and Y2 wire relay 558 are open, no signal is sent along the Y1 or Y2 wires to the indoor control board 526, and thus, the cooling system is powered off. Additionally, as depicted in FIG. 5, in one or more embodiments, the default states for the Y1 wire relay 557 and the Y2 wire relay 558 are to be closed.

Additionally, in one or more embodiments, the alarm relay 559 may be electrically disposed between the power supply and an alarm (not shown), which includes, in part, the buzzer 562 and the LED 563. Thus, when the alarm relay 559 is closed, 24 volt A/C power may be delivered to the alarm on the A2L control board 550, which powers at least the buzzer 562 and the LED 563 on. Further, when the alarm relay 559 is open, no power is delivered to the alarm on the A2L control board and it remains powered off. Additionally, as depicted in FIG. 5, in one or more embodiments, the default state for the alarm relay 559 is to be closed.

Lastly, in one or more embodiments, the dry contact relay 564 may be electrically disposed between the power supply and a ventilator (not shown) if the HVAC system 500 includes a ventilator, which is electrically coupled to the A2L control board 550 by way of the first and second ventilator contact points 565*a* and 565*b*. Thus, when the dry contact relay 564 is closed, 24 volt A/C power may be delivered to the ventilator, which powers the ventilator on. Further, when the dry contact relay 564 is open, no power is delivered to the ventilator and it remains powered off. Additionally, as depicted in FIG. 5, in one or more embodiments, the default state for the dry contact relay 564 is to be closed.

Further, in one or more embodiments, once the system is turned on, the A2L control board 550 may be configured to open all relays except for the R wire relay 553, which may be configured to be closed so as to provide the 24 volt A/C power to the thermostat 540 and power the thermostat 540 on. Furthermore, as discussed above, in one or more embodiments, the A2L control board 550 may be configured to act as a passthrough for any signals the thermostat sends during operation of the system. By way of example only, if the HVAC system 500 is required to cool the inside of a building, the thermostat may send signals along both the G and Y1 wires to the A2L control board 550. The A2L control board 550 may be configured to receive those signals and correspondingly close the G wire relay 554 and the Y1 wire relay 557 such that a 24 volt A/C signal may be passed to the indoor control board 526 along the G wire and the Y1 wire. Once received, the indoor control board 526 may be configured to turn on the blower motor 523 and run the cooling system as is called for by a signal on the G wire and Y1 wire.

Further, in one or more embodiments, the power supply may be coupled to the first sensor connector 560 and the second sensor connector 561, separately. Thus, in one or more embodiments, the A2L control board 550 may separately test one or more A2L sensors 570 before closing the R wire relay 553 and powering up the thermostat 540 and the outdoor unit 530. This allows for the A2L control board 550 to make sure that the sensors 570 are working properly and there are no A2L refrigerant leaks before beginning the system. While two separate sensor connectors are depicted, one of ordinary skill in the art would understand that the A2L control board may instead include a sensor signal-in contact and a sensor signal-out contact and the one or more sensors may be run in series instead of in parallel.

Thus, when the A2L control board 550 receives a signal from the A2L sensor 570 that there is an A2L refrigerant leak, the A2L control board 550 may be configured to carry out the required safety measures required by A2L safety standards. More specifically, in one or more embodiments, if a leak is detected, the A2L control board 550 may be configured to cut off power to the thermostat 540, and thus, to the outdoor unit 530, by opening the R wire relay 553. Further, if a leak is detected, the A2L control board 550 may be configured to cut off power to all parts of the indoor unit 520 except the blower motor 523 by opening at least the W1 wire relay 555 and the W2 wire relay 556 and closing at least the G wire relay 554. Opening the W1 wire relay 555 and the W2 wire relay 556 will ensure that all heating functions are shut off, while closing the G wire relay 554 will ensure that the blower motor 523 is turned on. In one or more embodiments, the Y1 wire relay 557 and the Y2 wire relay 558 may also be closed as cutting power to the outdoor unit 530 ensures that all cooling functionality is shut off, but the signal on the Y1 and Y2 wire cause the indoor control board 526 to turn up the speed on the blower motor 523 so it blows more air, faster. This allows the HVAC system 500 to meet the A2L safety requirements within the requisite time after detection of an A2L refrigerant leak.

Additionally, in one or more embodiments, if a leak is detected, the A2L control board 550 may close the alarm relay 559 and the dry contact relay 564. Closing the alarm relay 559 will cause the alarm on the A2L control panel 550 to be powered on, which will include, at least, turning on the buzzer 562 and the LED 563 to give auditory and visual alerts that a leak has been detected. Further, if the HVAC system 500 includes a ventilator, closing the dry contact relay 564 will cause the ventilator to be powered on, which will aid in removing any concentrations of A2L refrigerant leaked into the HVAC system 500.

Further, in one or more embodiments, if the A2L control board 550 fails, the relays all revert to their default state. As discussed above and as depicted in FIG. 5, in a default state, the G wire relay 554, the Y1 wire relay 557, the Y2 wire relay 558, the alarm relay 559, and the dry contact relay 564 may be closed, while the R wire relay 553, the W1 wire relay 555, and the W2 wire relay 556 may be open. Thus, if the A2L control board 550 fails, power will be blocked from the thermostat 540, and thus, from the outdoor unit 530 and the only signals the indoor unit 520 will receive and act on will cause the blower motor 523 to be turned on as fast as it can go. Additionally, if the A2L control board 550 fails, the alarm will be turned on and the ventilator will be turned on.

Figure 6:
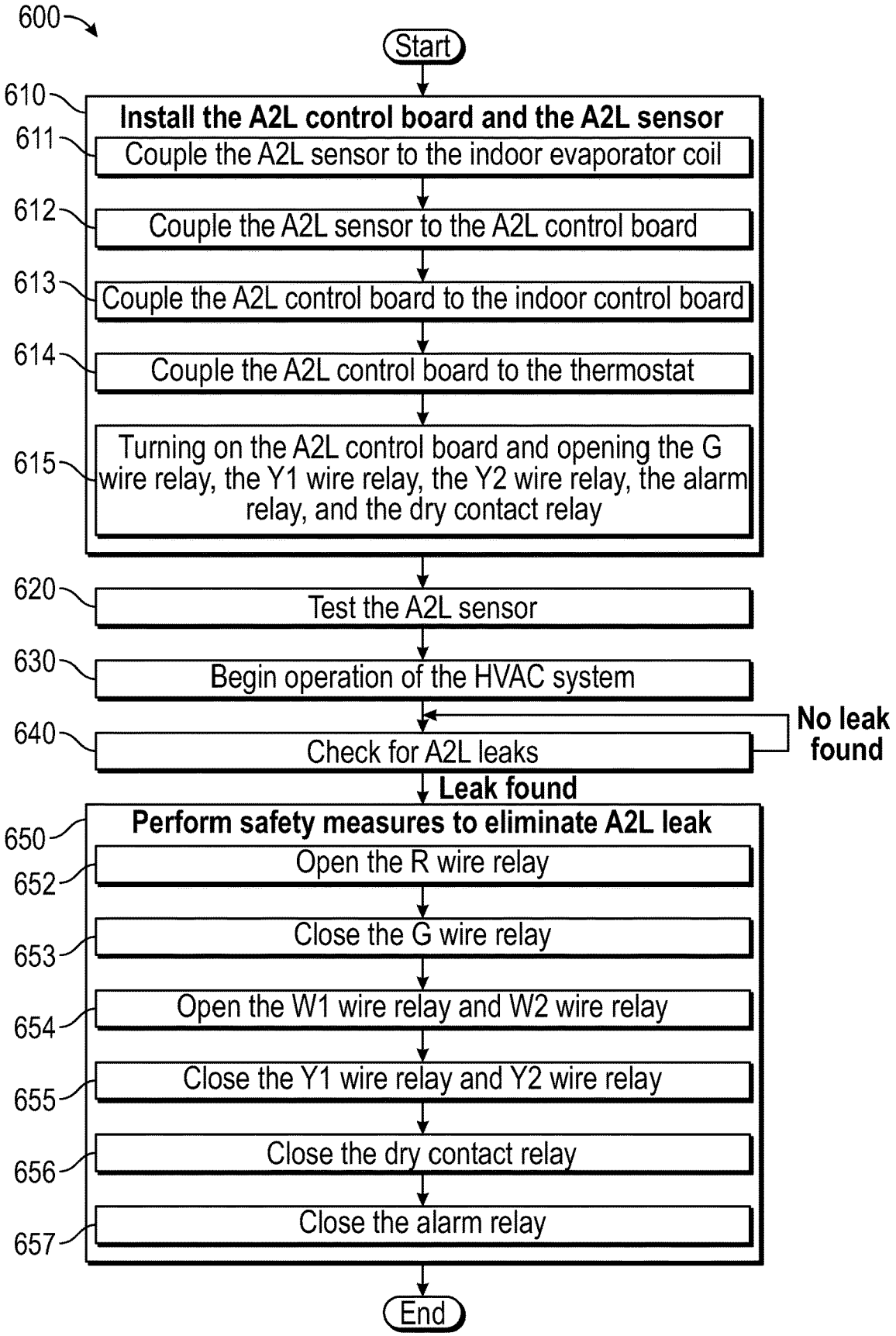
FIG. 6 is a flow chart illustrating another embodiment of a method of operating a non-communicating HVAC system using an A2L refrigerant, according to one or more embodiments.

Referring now to FIG. 6, a flow chart of an embodiment of a method 600 of installing and operating a non-communicating HVAC system using an A2L refrigerant as described above with respect to FIG. 5, according to one or more embodiments, is illustrated. Beginning with an HVAC system 500 in which the indoor unit 520 has been disposed on an inside 511 of a building 510, the outdoor unit 530 has been disposed on an outside 512 of the building 510, the indoor control board 526 has been electrically coupled to a blower motor 523 of the blower 521, and the outdoor control board 531 has been electrically coupled to the thermostat 540, the method 600 may include one or more of the following: (step 610) installing the A2L control board 550 and the A2L sensor 570 into the HVAC system 500, (step 620) testing the A2L sensor 570, (step 630) beginning operation of the HVAC system 500, (step 640) checking for A2L refrigerant leaks, and (step 650) performing safety measures upon detecting an A2L refrigerant leak.

At step 610, an A2L control board 550 and an A2L sensor 570 may be installed into the HVAC system 500. Installation of the A2L control board 550 and the A2L sensor 570 may include, at least, (step 611) physically coupling the A2L sensor 570 to the indoor evaporator coil 524 of the indoor unit 520, (step 612) electrically coupling the A2L sensor 570 to the A2L control board 550, (step 613) electrically coupling the A2L control board 550 to the indoor control board 526, (step 614) electrically coupling the A2L control board 550 to the thermostat 540, and (step 615) turning on the A2L control board 550 and opening the G wire relay 554, the Y1 wire relay 557, the Y2 wire relay 558, the alarm relay 559, and the dry contact relay 564.

In one or more embodiments, at step 611, the A2L sensor 570 may be disposed within the indoor unit 520 such that it is adjacent or connected to the indoor evaporator coil 524 such that the A2L sensor 570 is able to detect an A2L refrigerant leak if one occurs. Further, at step 612, the A2L sensor 570 may be electrically coupled to the A2L control board 550 such that the A2L sensor 570 and the A2L control board 550 have two-way communication between them. By way of example, in one or more embodiments, an A2L sensor 570 may be electrically coupled to a first sensor connector 557 of the A2L control board 550 by way of an RS-485 bus. One of ordinary skill in the art would appreciate that in other embodiments, any other electric coupling that allows for two-way communication between the A2L sensor 570 and the A2L control board 550 may be used.

At step 613, the A2L control board 550 may be electrically coupled to the indoor control board 526. In one or more embodiments, R, C, G, W1, W2, Y1, Y2, O, and Dehum wires may be electrically coupled on one end to a terminal block within the indoor control board 526 and on the other end to the second terminal block 552 of the A2L control board 550. Further, at step 614, the A2L control board 550 may be electrically coupled to the thermostat 540. In one or more embodiments, R, C, G, W1, W2, Y1, Y2, O, and Dehum wires may be electrically coupled on one end to a terminal block within the thermostat 540 and on the other end to the first terminal block 551 of the A2L control board 550. Thus, in one or more embodiments, the A2L control board 550 may be configured to receive control signals from the thermostat 540 and send those same control signals to the indoor control board 526. Further, in one or more embodiments, the A2L control board 550 may be configured to provide power to the thermostat 540 by way of the R wire so as to power on the thermostat, which in turn powers on the outdoor unit 530. In one or more embodiments, the power provided to the thermostat 540 by the A2L control board 550 is a 24 volt A/C power.

At step 615, the A2L control board 550 may be turned on, and the G wire relay 554, the Y1 wire relay 557, the Y2 wire relay 558, the alarm relay 559, and the dry contact relay 564 may be opened. In one or more embodiments, when the A2L control board 550 is turned on, the relays are in the default state, which includes the G wire relay 554, the Y1 wire relay 557, the Y2 wire relay 558, the alarm relay 559, and the dry contact relay 564 being closed. Thus, in order to make sure signals are not unnecessarily provided to the indoor control board 526 to turn on the blower motor 523 and the alarm and ventilator are not unnecessarily run, in one or more embodiments, when the A2L control board 550 powers up, the A2L control board opens the G wire relay 554, the Y1 wire relay 557, the Y2 wire relay 558, the alarm relay 559, and the dry contact relay 564.

At step 620, the A2L sensor 570 may be tested to confirm that it is properly operational. Once electrically coupled to the A2L control board 550, in one or more embodiments, the A2L sensor 570 may perform an internal diagnostic check to make sure that the sensor is operating properly and may detect an A2L refrigerant leak. If the diagnostic check is successful, the A2L sensor 570 may communicate the successful diagnostic check to the A2L control board 550, which can begin operation of the HVAC system 500. If the A2L sensor 570 fails the diagnostic check, the A2L sensor 570 will communicate the failed diagnostic check to the A2L control board 550, which will remain in the default configuration, keeping the HVAC system 500 from operating until the A2L sensor is repaired or replaced.

At step 630, the A2L control board 550 may begin operation of the HVAC system 500. In order to begin operation, in one or more embodiments, the A2L control board 550 may close the R wire relay 553 of the A2L control board 550. Closing the R wire relay 553 allows for the 24 volt A/C power of the A2L control board 550 to pass to the thermostat 540 and therefrom to the outdoor unit 530. Once power has been turned on for the thermostat 540, it may then be able to send signals to the indoor unit 520, through the A2L control board 550, as well as to the outdoor unit 530 and the HVAC system 500 may be fully operational.

At step 640, while the HVAC system is running, in one or more embodiments, the A2L sensor 570 may check for A2L refrigerant leaks. The A2L sensor 570 may continuously check for A2L refrigerant leaks while the HVAC system 500 is running, such that if a check comes back negative for an A2L refrigerant leak, the A2L sensor 570 repeats step 640. However, if the AL2 sensor 570 detects an A2L leak, then the A2L sensor 570 communicates the A2L refrigerant leak to the A2L control board and the HVAC system continues to step 650.

At step 650, the HVAC system 500, by way of the A2L control board 550, may perform safety measures to eliminate the threat of the detected A2L refrigerant leak. Specifically, the HVAC system 500 may (step 652) open the R wire relay 553, (step 653) close the G wire relay 554, (step 654) open the W1 wire relay 555 and the W2 wire relay 556, (step 655) close the Y1 wire relay 557 and the Y2 wire relay 558, (step 656) close the dry contact relay 564, and (step 657) close the alarm relay 559.

At step 652, opening the R wire relay 553 prevents the A2L control board 550 from distributing the 24 volt A/C power to the thermostat 540. Removing the 24 volt A/C power from the thermostat 540 in turn removes power from the outside unit 530, which is configured to receive 24 volt A/C power signals directly from the thermostat. Additionally, at step 653, closing the G wire relay 554 causes the A2L control board 550 to send a 24 volt A/C power along the G wire to the inside control board 526, which starts the blower motor 523 when it receives the signal along the G wire. Further, at step 654, opening the W1 wire relay 555 and the W2 wire relay 556 ensures that no signal is sent to the indoor control board 526 and thus, heating operations are not run while the system is experiencing a refrigerant leak. Furthermore, at step 655, closing the Y1 wire relay 557 and the Y2 wire relay 558 causes the A2L control board 550 to send a 24 volt A/C power along the Y1 and Y2 wires to the indoor control board 526. The indoor control board 526 interprets the signals along the Y1 and Y2 wires to call for first and second stage cooling operations, but because the compressor in the outdoor unit 530 is powered off, the only effect is that the indoor control board 526 runs the blower motor 532 at its highest level.

Further, at step 656, closing the dry contact relay 564 causes the 24 volt A/C power from the A2L control board 550 to power an attached ventilator on if the HVAC system 500 includes a ventilator. Additionally, at step 657, closing the alarm relay 559 causes the 24 volt A/C power from the A2L control board 550 to power the alarm on, which includes, at least, powering on visual and auditory alarms in the form of the buzzer 562 and the LED 563.

Further, while listed as separate steps, one of ordinary skill would appreciate that in one or more embodiments, steps 652-657 may take place in any order, or in other embodiments, steps 652-657 may occur simultaneously. Additionally, one of ordinary skill in the art would appreciate that all steps 652-657 may be completed within the requisite time after detection of an A2L refrigerant leak as required by A2L safety standards.

Thus, in one or more embodiments, in response to a communication from the A2L sensor 570 that an A2L refrigerant leak has been detected, the A2L control board 550 may turn off the outdoor unit 530, turn on a ventilator if the HVAC system 500 has one, turn on visual and auditory alarms that an A2L refrigerant has been detected, and ensure that the only signals the indoor unit 520 will receive and act on will cause the blower motor 523 to be turned on as fast as it can go.

While the method 600 is described with respect to an HVAC system 500 including a single A2L sensor 570, one of ordinary skill in the art, would understand that any number of sensors may be used in the system and the method may include electrically coupling the further sensors to the control board, testing the further sensors, and communicating with the further sensors as the further sensors check for A2L refrigerant leaks.

Figure 7:
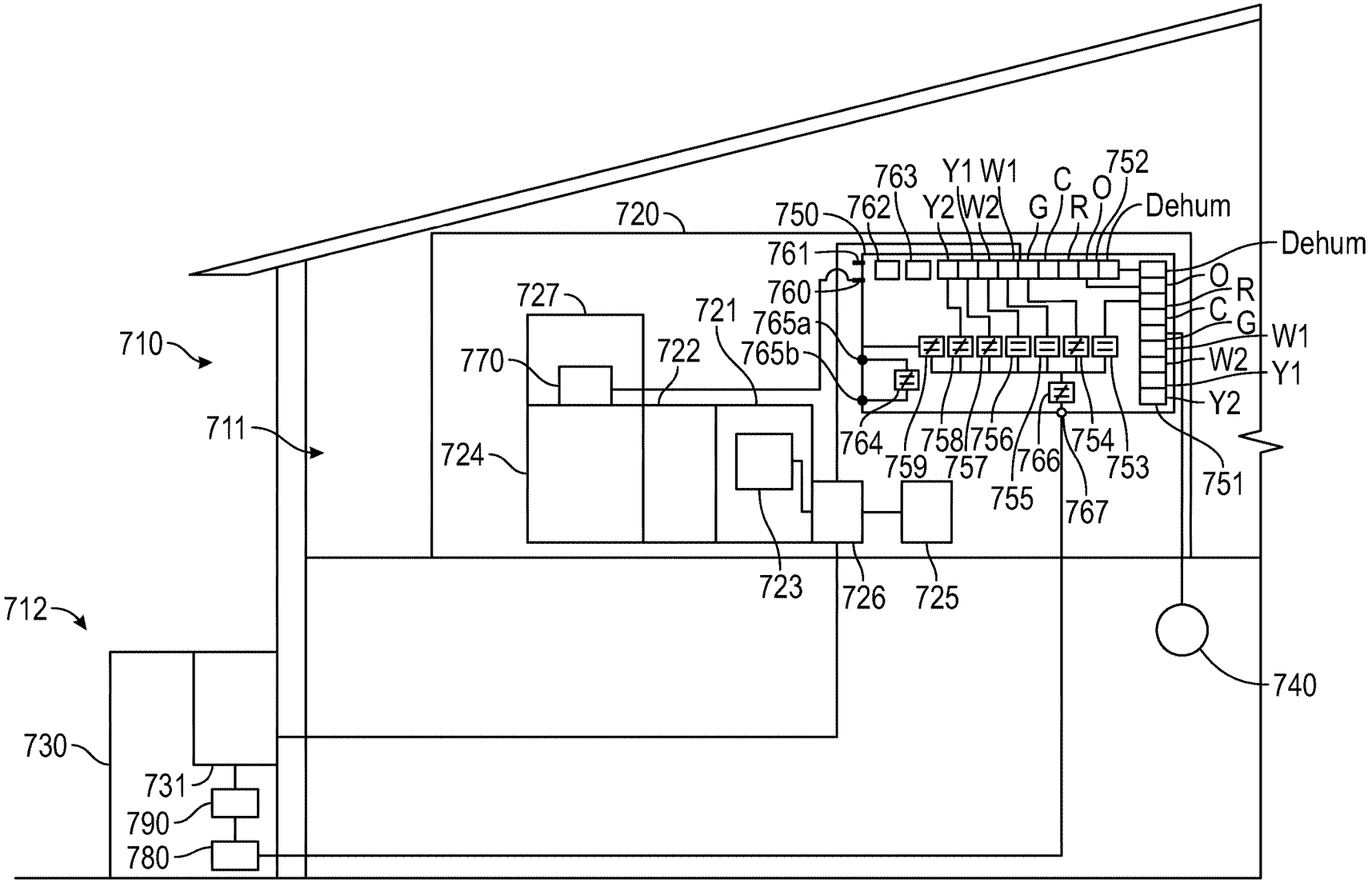
FIG. 7 shows another communicating HVAC system using an A2L refrigerant, according to one or more embodiments.

FIG. 7 shows a communicating HVAC system using an A2L refrigerant, according to a one or more embodiments. In one or more embodiments, an HVAC system 700 may be used to distribute cooled or heated air throughout a building 710 to adjust the ambient air temperature inside 711 of the building 710. The HVAC system may include an indoor unit 720, an outdoor unit 730, a thermostat 740, an A2L control board 750, an A2L sensor 770, an outdoor relay 780, and a high pressure switch 790.

Generally, in one or more embodiments, the indoor unit 720 may be fluidly coupled to the outdoor unit 730 such that an A2L refrigerant may flow between the indoor unit 720 and the outdoor unit 730 to cool or heat air within the indoor unit 720. Further, in one or more embodiments, both the indoor unit 720 and the outdoor unit 730 may be communicatively coupled to each other by way of an RS-485 system communication. Furthermore, in one or more embodiments, the A2L control board 750 may be directly electrically and/or communicatively coupled to both the indoor unit 720 and the thermostat 740, and also indirectly electrically coupled to the outdoor unit 730 by way of the outdoor relay 780 and the high pressure switch 790. The thermostat 740 may be electrically coupled to the A2L control board 750 such that it may send communications and signals to the indoor unit 720 through the A2L control board 750. Thus, the A2L control board 750 may be configured to directly affect the operation of the indoor unit 720 by way of those communications and signals and may be configured to directly affect the operation of the outdoor unit 730 by way of the outdoor relay 780 and the high pressure switch 790. Further, the A2L sensor 770 may be physically disposed within the indoor unit 720 and electrically coupled to the A2L control board 750. The A2L sensor 770 may be configured to send signals to the A2L control board 750 when an A2L refrigerant leak is detected.

While the A2L control board 750 is depicted as being electrically and communicatively coupled to the indoor unit 720, the thermostat 740, and the A2L sensor 770 by way of a wired connection, one of ordinary skill in the art would understand that the indoor unit 720, the thermostat 740, and the A2L sensor 770 may just be communicatively coupled to the A2L control board 750 wirelessly. In one or more embodiments, the indoor unit 720, the thermostat 740, and the A2L sensor 770 may be communicatively coupled to the A2L control board 750 by any wireless means, such as Wi-Fi or Bluetooth.

In one or more embodiments, indoor unit 720 may be disposed on the inside 711 of the building 710. The indoor unit 720 may be configured to distribute cooled or heated air to rooms on the inside 711 of the building 710. The indoor unit 720 may be any type of HVAC system that includes a blower 721 and a heat exchanger 727 having an indoor evaporator coil 724. Thus, in one or more embodiments, the indoor unit 720 may be either a furnace or an air handler, as both types of system include, at least, a blower and an indoor evaporator coil. Additionally, the indoor evaporator coil 724 may be disposed adjacent to the blower 721, such that when the blower 721 blows air within the indoor unit 720, the air is blown through the evaporator coil 724.

Further, in one or more embodiments, the blower 721 may include a blower fan 722 and a blower motor 723. By way of example, in one or more embodiments, the blower motor 723 may be constant torque motor, while in other embodiments, the blower motor 723 may be a permanent split capacitor (PSC) motor. The blower motor 723 may be mechanically coupled to the blower fan 722 such that when the blower motor 723 is turned on, the blower fan 722 is configured to spin and cause a movement of air out from the blower 721 and through the indoor evaporator coil 724. The indoor evaporator coil 724 may be configured to receive the A2L refrigerant on the inside of the coil while air from the blower 721 is blown across the outside of the coil, which allows for heat to exchange either from the A2L refrigerant to the air or vice versa. The A2L refrigerant, after cooling or heating the air, may be cycled back to the outdoor unit 730, where it will go through the reverse heat exchange process before returning to the indoor evaporator coil 724. Additionally, indoor unit 720 is configured to distribute the air that is blown from the blower 721 and across the indoor evaporator coil 724 to the rooms on the inside 711 of the building 710 by way of the force of the blower 721.

The indoor unit 720 may also include a transformer 725 and an indoor control board 726. The transformer 725 may be directly electrically coupled to and configured to provide 24 volts A/C power to the indoor control board 726. Further, the indoor control board 726 may be electrically coupled to, at least, the A2L control board 750 and the blower motor 723.

Further, the outdoor unit 730 may be disposed on an outside 712 of the building 710 and be configured to use the outdoor environment to reheat or cool down the A2L refrigerant after it has been run through the indoor evaporator coil 724. The outdoor unit 730 may include, but is not limited to, either a heat pump or an air conditioner. Whether the outdoor unit 730 is a heat pump or an air conditioner, the outdoor unit 730 may include a compressor (not shown), an outdoor coil (not shown), and an outdoor control board 731. The outdoor unit 730 may be configured to communicate with the indoor unit 720 through RS-485 system communication between the indoor control board 726 and the outdoor control board 731. Further, the outdoor control board 731 may be electrically coupled to the A2L control board 750 as discussed below.

Still referring to FIG. 7, in one or more embodiments, the A2L sensor 770 may be configured to detect an A2L refrigerant leak and send a signal reporting as much. In one or more embodiments, the A2L sensor 770 may be configured to detect an A2L refrigerant leak by one of a number of methods, including, at least, by detecting an amount or a concentration of A2L refrigerant in the air that exceeds a leak threshold. The A2L sensor 770 may be electrically coupled to and communicate with the A2L control board 750. In one or more embodiments, the A2L sensor 770 may be electrically coupled to the A2L control board 750 by way of a first sensor connector 760. The A2L sensor 770 may be configured to communicate to the A2L control board 750 that the A2L sensor 770 is connected to the system and working properly. Additionally, when the A2L sensor 770 detects an A2L refrigerant leak, it may communicate the A2L refrigerant leak to the A2L control board 750, which may be configured to receive the signal and perform the safety measures required by A2L safety standards. In one or more embodiments, the A2L sensor 770 and the A2L control board 750 may be electrically coupled by way of an RS-485 bus; however, one of ordinary skill in the art would understand that any type of electrical connection that allows the A2L sensor 770 to send a signal to the A2L control board 750 may be used.

Further, in one or more embodiments, the A2L sensor 770 may be disposed within the indoor unit 720 so that it may detect an A2L refrigerant leak that occurs within the indoor evaporator coil 724 of the HVAC system 700. As depicted, in one or more embodiments, the A2L sensor 770 may be disposed directly against the indoor evaporator coil to minimize the time it takes for the A2L sensor 770 to detect an A2L refrigerant leak. Further, while the A2L sensor 770 is depicted within the indoor unit 720, one or ordinary skill in the art would understand that the A2L sensor 770 may instead be disposed within the outdoor unit 730. Further, while a single sensor is depicted, one of ordinary skill in the art would understand that multiple sensors may be incorporated into the HVAC system to ensure that an A2L refrigerant leak is detected and the required safety measures are taken within the time required by A2L safety standards. For example, one of ordinary skill in the art would understand that the HVAC system may include two A2L sensors, with both A2L sensors disposed within the indoor unit, both A2L sensors disposed within the outdoor unit, or one A2L sensor disposed within each of the indoor unit and the outdoor unit. Thus, one of ordinary skill in the art would understand that in one or more embodiments, a plurality of A2L sensors may be disposed within the HVAC system with one or more A2L sensors disposed within the indoor unit and/or one or more A2L sensors disposed within the outdoor unit as may be determined necessary to ensure that an A2L refrigerant leak is detected and the required safety measures are taken within the time required by A2L safety standards.

Additionally, referring to FIG. 7, in one or more embodiments, the A2L control board 750 may be disposed inside of the indoor unit 720. However, one of ordinary skill in the art would understand that, in one or more embodiments, the A2L control board 750 may be disposed outside of the indoor unit 720 and either connected to the indoor unit 720 or adjacent to the indoor unit 720. Further, in addition to being electrically coupled to the indoor control board 726, the thermostat 740, and the A2L sensor 770, as discussed above, the A2L control board 750 may be electrically coupled to the outdoor control board 731 by way of the outdoor relay 780 and the high pressure switch 790. In one or more embodiments, the outdoor relay 780 and the high pressure switch 790 may be electrically coupled in series between the A2L control board 750 and the outdoor control board 731. In one or more embodiments, the outdoor relay 780 may be directly electrically coupled to the A2L control board 750 such that the outdoor relay 780 is configured to open upon receiving a 24 volt A/C power signal from the A2L control board 750. Further, in one or more embodiments, the high pressure switch 790 is electrically coupled to the outdoor control board 731 such that when the high pressure switch 790 opens, the outdoor unit 730 shuts down completely. Furthermore, in one or more embodiments, opening the outdoor relay 780 causes the high pressure switch 790 to open, which causes the outdoor unit 730 to shut down completely.

In one or more embodiments, the A2L control board 750 may include a power supply (not shown), a first terminal block 751, a second terminal block 752, an R wire relay 753, an G wire relay 754, a W1 wire relay 755, a W2 wire relay 756, a Y1 wire relay 757, a Y2 wire relay 758, an alarm relay 759, a first sensor connector 760, a second sensor connector 761, a buzzer 762, an LED 763, a dry contact relay 764, first and second ventilator contact points 765*a* and 765*b*, and an outdoor unit relay 766. The power supply may be coupled to circuitry on the A2L control board 750 such that the A2L control board may open and close, at least, the R wire relay 753, the G wire relay 754, the W1 wire relay 755, the W2 wire relay 756, the Y1 wire relay 757, the Y2 wire relay 758, the alarm relay 759, the dry contact relay 764 and the outdoor unit relay 766.

In one or more embodiments, the thermostat 740 may be electrically coupled to the first terminal block 751, and the indoor control board 726 may be electrically coupled to the second terminal block 752. Further, in one or more embodiments, any signals received by the A2L control board 750 from the thermostat 740 may be passed unchanged, by the A2L control board 750, to the indoor control board 730 through the second terminal block 752.

In one or more embodiments, the R wire relay 753 may be electrically disposed between the power supply and the R wire connection of the first terminal block 751. Thus, when the R wire relay 753 is closed, 24 volt A/C power may be delivered from the A2L control board 750 to the thermostat 740 via the first terminal block 751, which powers the thermostat 740 on. Further, when the R wire relay 753 is open, no power is able to reach the thermostat, and thus, the thermostat is turned off completely. Additionally, as depicted in FIG. 7, in one or more embodiments, the default state for the R wire relay 753 is to be open.

In one or more embodiments, the G wire relay 754 may be electrically disposed between the power supply and the G wire connection of the second terminal block 752. Thus, when the G wire relay 754 is closed, 24 volt A/C power may be delivered from the A2L control board 750 to the indoor control board 726 via the first terminal block 751, which signals the indoor control board 726 to power the blower motor 723 on. Further, when the G wire relay 754 is open, no signal is sent along the G wire to the indoor control board 726, and thus, the blower motor 723 is powered off. Additionally, as depicted in FIG. 7, in one or more embodiments, the default state for the G wire relay 754 is to be closed.

In one or more embodiments, the W1 wire relay 755 may be electrically disposed between the power supply and the W1 wire connection of the second terminal block 752, and the W2 wire relay 756 may be electrically disposed between the power supply and the W2 wire connection of the second terminal block 752. Thus, when the W1 wire relay 755 and the W2 wire relay 756 are closed, 24 volt A/C power may be delivered from the A2L control board 750 to the indoor control board 726 via the first terminal block 751, which signals the indoor control board 726 to run the heating system's first and second stages, respectively. Further, when the W1 wire relay 755 and W2 wire relay 756 are open, no signal is sent along the W1 or W2 wires to the indoor control board 726, and thus, the heating system is powered off. Additionally, as depicted in FIG. 7, in one or more embodiments, the default states for the W1 wire relay 755 and the W2 wire relay 756 are to be open.

In one or more embodiments, the Y1 wire relay 757 may be electrically disposed between the power supply and the Y1 wire connection of the second terminal block 752, and the Y2 wire relay 758 may be electrically disposed between the power supply and the Y2 wire connection of the second terminal block 752. Thus, when the Y1 wire relay 757 and the Y2 wire relay 758 are closed, 24 volt A/C power may be delivered from the A2L control board 750 to the indoor control board 726 via the first terminal block 751, which signals the indoor control board 726 to run the cooling system's first and second stages, respectively. Further, when the Y1 wire relay 757 and Y2 wire relay 758 are open, no signal is sent along the Y1 or Y2 wires to the indoor control board 726, and thus, the cooling system is powered off. Additionally, as depicted in FIG. 7, in one or more embodiments, the default states for the Y1 wire relay 757 and the Y2 wire relay 758 are to be closed.

Further, in one or more embodiments, the alarm relay 759 may be electrically disposed between the power supply and an alarm (not shown), which includes, in part, the buzzer 762 and the LED 763. Thus, when the alarm relay 759 is closed, 24 volt A/C power may be delivered to the alarm on the A2L control board 750, which powers at least the buzzer 762 and the LED 763 on. Further, when the alarm relay 759 is open, no power is delivered to the alarm on the A2L control board and it remains powered off. Additionally, as depicted in FIG. 7, in one or more embodiments, the default state for the alarm relay 759 is to be closed.

Furthermore, in one or more embodiments, the dry contact relay 764 may be electrically disposed between the power supply and a ventilator (not shown) if the HVAC system 700 includes a ventilator, which is electrically coupled to the A2L control board 750 by way of the first and second ventilator contact points 765*a* and 765*b*. Thus, when the dry contact relay 764 is closed, 24 volt A/C power may be delivered to the ventilator, which powers the ventilator on. Further, when the dry contact relay 764 is open, no power is delivered to the ventilator and it remains powered off. Additionally, as depicted in FIG. 7, in one or more embodiments, the default state for the dry contact relay 764 is to be closed.

Additionally, in one or more embodiments, the outdoor unit relay 766 may be electrically disposed between the power supply and an outdoor unit contact point 767. In one or more embodiments, the outdoor relay 780 may be electrically coupled to the A2L control board 750 by way of the outdoor unit contact point 767. Thus, when the outdoor unit relay 766 is closed, 24 volt A/C power may be delivered to the outdoor relay 780 causing it to open, thus opening the high pressure switch 790 and shutting off the outdoor unit 730. Further, when the outdoor unit relay 766 is open, no power is delivered to the outdoor relay 780 and the outdoor unit 730 continues to operate. Additionally, as depicted in FIG. 7, in one or more embodiments, the default state for the outdoor unit relay 766 is to be closed.

Further, in one or more embodiments, once the system is turned on, the A2L control board 750 may be configured to open all relays except for the R wire relay 753, which may be configured to be closed so as to provide the 24 volt A/C power to the thermostat 740 and power the thermostat 740 on. Furthermore, as discussed above, in one or more embodiments, the A2L control board 750 may be configured to act as a passthrough for any signals the thermostat sends during operation of the system. By way of example only, if the HVAC system 700 is required to cool the inside of a building, the thermostat may send signals along both the G and Y1 wires to the A2L control board 750. The A2L control board 750 may be configured to receive those signals and correspondingly close the G wire relay 754 and the Y1 wire relay 757 such that a 24 volt A/C signal may be passed to the indoor control board 726 along the G wire and the Y1 wire. Once received, the indoor control board 726 may be configured to turn on the blower motor 723 and run the cooling system as is called for by a signal on the G wire and Y1 wire.

Further, in one or more embodiments, the power supply may be coupled to the first sensor connector 760 and the second sensor connector 761, separately. Thus, in one or more embodiments, the A2L control board 750 may separately test one or more A2L sensors 770 before closing the R wire relay 753 and powering up the thermostat 740. This allows for the A2L control board 750 to make sure that the sensors 770 are working properly and there are no A2L refrigerant leaks before beginning the system. While two separate sensor connectors are depicted, one of ordinary skill in the art would understand that the A2L control board may instead include a sensor signal-in contact and a sensor signal-out contact and the one or more sensors may be run in series instead of in parallel.

Thus, when the A2L control board 750 receives a signal from the A2L sensor 770 that there is an A2L refrigerant leak, the A2L control board 750 may be configured to carry out the required safety measures required by A2L safety standards. More specifically, in one or more embodiments, if a leak is detected, the A2L control board 750 may be configured to cut off power to the thermostat 740 by opening the R wire relay 753 and to cause the outdoor unit 730 to turn off by closing the outdoor unit relay 766. Further, if a leak is detected, the A2L control board 750 may be configured to cut off power to all parts of the indoor unit 720 except the blower motor 723 by opening at least the W1 wire relay 755 and the W2 wire relay 756 and closing at least the G wire relay 754. Opening the W1 wire relay 755 and the W2 wire relay 756 will ensure that all heating functions are shut off, while closing the G wire relay 754 will ensure that the blower motor 723 is turned on. In one or more embodiments, the Y1 wire relay 757 and the Y2 wire relay 758 may also be closed as cutting power to the outdoor unit 730 ensures that all cooling functionality is shut off, but the signal on the Y1 and Y2 wire may cause the indoor control board 726 to turn up the speed on the blower motor 723 so it blows more air, faster. Further, closing the outdoor unit relay 766 in response to an A2L refrigerant leak being detected causes power to be directly applied to the outdoor relay 780. Directly applying power to the outdoor relay 780 causes the outdoor relay 780 to open. Furthermore, opening the outdoor relay 780 is configured to cause the high pressure switch 790 to open. Additionally, the outdoor unit 730 is configured to shut down completely if the high pressure switch 790 is opened. Thus, closing the outdoor unit relay 766 is configured to shut down the outdoor unit 730 completely. This allows the HVAC system 700 to meet the A2L safety requirements within the requisite time after detection of an A2L refrigerant leak.

While FIG. 7 depicts one or more embodiments of the present invention that utilize an outdoor relay 780 and a high pressure switch 790 in order to shut off the outdoor unit in the event of an A2L refrigerant leak, one of ordinary skill in the art would understand that any means of turning off the compressor of the outdoor unit would work to properly meet the A2L safety requirements. By way of example, in one or more embodiments, the HVAC system may include an A2L control board that is electrically coupled to a contactor, where the contactor is configured to contact the outdoor control board such that the outdoor unit shuts off in the event of an A2L refrigerant leak being detected. Further, in other embodiments, the A2L control board may be communicatively coupled to the outdoor control board by way of an RS-485 system communication such that the A2L control board can tell the outdoor control board to shut down the outdoor unit in the event of an A2L leak being detected. Furthermore, in one or more embodiments, the A2L control board may be electrically coupled to a relay, where the relay is disposed between the outdoor control board and the compressor of the outdoor unit such that when the relay is opened, power from the outdoor control board does not reach the compressor, and the compressor shuts down.

Further, while in one or more embodiments a 24 volt A/C signal is used by the A2L control board to communicate with the outdoor relay to shut down the outdoor unit, one of ordinary skill in the art would understand that, in one or more embodiments, the A2L control board may send digital signals to the outdoor relay. One of ordinary skill in the art would understand that digital signals may also be used with a contactor or any other relay coupled to the outdoor control board to shut down the outdoor unit. Furthermore, in one or more embodiments, the A2L control board may be wirelessly, communicatively coupled to the outdoor control board such that wireless signals may be used to turn off the outdoor unit.

Additionally, in one or more embodiments, if a leak is detected, the A2L control board 750 may close the alarm relay 759 and the dry contact relay 764. Closing the alarm relay 759 will cause the alarm on the A2L control panel 750 to be powered on, which will include, at least, turning on the buzzer 762 and the LED 763 to give auditory and visual alerts that a leak has been detected. Further, if the HVAC system 700 includes a ventilator, closing the dry contact relay 764 will cause the ventilator to be powered on, which will aid in removing any concentrations of A2L refrigerant leaked into the HVAC system 700.

Further, in one or more embodiments, if the A2L control board 750 fails, the relays all revert to their default state. As discussed above and as depicted in FIG. 7, in a default state, the G wire relay 754, the Y1 wire relay 757, the Y2 wire relay 758, the alarm relay 759, the dry contact relay 764, and the outdoor unit relay 766 may be closed, while the R wire relay 753, the W1 wire relay 755, and the W2 wire relay 756 may be open. Thus, if the A2L control board 750 fails, the outdoor unit 730 will be shut down by way of the opened high pressure switch, and the only signals the indoor unit 720 will receive and act on will cause the blower motor 723 to be turned on as fast as it can go. Additionally, if the A2L control board 750 fails, the alarm will be turned on and the ventilator will be turned on.

Figure 8:
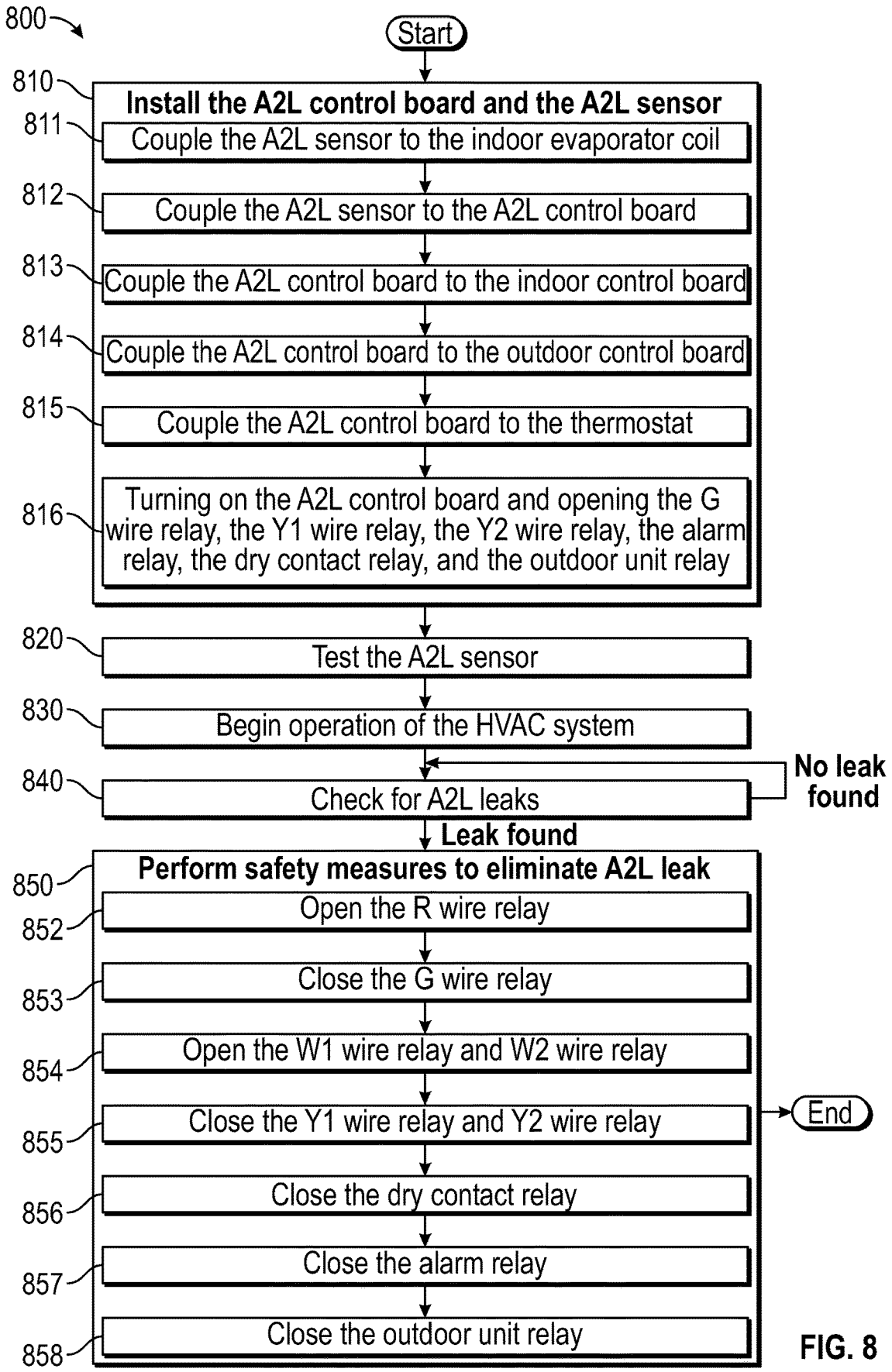
FIG. 8 is a flow chart illustrating another embodiment of a method of operating a non-communicating HVAC system using an A2L refrigerant, according to one or more embodiments.

Referring now to FIG. 8, a flow chart of an embodiment of a method 800 of installing and operating a communicating HVAC system using an A2L refrigerant as described above with respect to FIG. 7, according to one or more embodiments, is illustrated. Beginning with an HVAC system 700 in which the indoor unit 720 has been disposed on an inside 711 of a building 710, the outdoor unit 730 has been disposed on an outside 712 of the building 710, the indoor control board 726 has been electrically coupled to the transformer 725 and a blower motor 723 of the blower 721, and the outdoor control board 731 has been communicatively coupled to the indoor control board 726, the method 800 may include one or more of the following: (step 810) installing the A2L control board 750 and the A2L sensor 770 into the HVAC system 700, (step 820) testing the A2L sensor 770, (step 830) beginning operation of the HVAC system 700, (step 840) checking for A2L refrigerant leaks, and (step 850) performing safety measures upon detecting an A2L refrigerant leak.

At step 810, an A2L control board 750 and an A2L sensor 770 may be installed into the HVAC system 700. Installation of the A2L control board 750 and the A2L sensor 770 may include, at least, (step 811) physically coupling the A2L sensor 770 to the indoor evaporator coil 724 of the indoor unit 720, (step 812) electrically coupling the A2L sensor 770 to the A2L control board 750, (step 813) electrically coupling the A2L control board 750 to the indoor control board 726, (step 814) electrically coupling the A2L control board 750 to outdoor control board 731, (step 815) electrically coupling the A2L control board 750 to the thermostat 740, and (step 816) turning on the A2L control board 750 and opening the G wire relay 754, the Y1 wire relay 757, the Y2 wire relay 758, the alarm relay 759, the dry contact relay 764, and the outdoor unit relay 766.

In one or more embodiments, at step 811, the A2L sensor 770 may be disposed within the indoor unit 720 such that it is adjacent or connected to the indoor evaporator coil 724 such that the A2L sensor 770 is able to detect an A2L refrigerant leak if one occurs. Further, at step 812, the A2L sensor 770 may be electrically coupled to the A2L control board 750 such that the A2L sensor 770 and the A2L control board 750 have two-way communication between them. By way of example, in one or more embodiments, an A2L sensor 770 may be electrically coupled to a first sensor connector 757 of the A2L control board 750 by way of an RS-485 bus. One of ordinary skill in the art would appreciate that in other embodiments, any other electric coupling that allows for two-way communication between the A2L sensor 770 and the A2L control board 750 may be used.

At step 813, the A2L control board 750 may be electrically coupled to the indoor control board 726. In one or more embodiments, R, C, G, W1, W2, Y1, Y2, O, and Dehum wires may be electrically coupled on one end to a terminal block within the indoor control board 726 and on the other end to the second terminal block 752 of the A2L control board 750. Further, at step 815, the A2L control board 750 may be electrically coupled to the thermostat 740. In one or more embodiments, R, C, G, W1, W2, Y1, Y2, O, and Dehum wires may be electrically coupled on one end to a terminal block within the thermostat 740 and on the other end to the first terminal block 751 of the A2L control board 750. Thus, in one or more embodiments, the A2L control board 750 may be configured to receive control signals from the thermostat 740 and send those same control signals to the indoor control board 726. Further, in one or more embodiments, the A2L control board 750 may be configured to provide power to the thermostat 740 by way of the R wire so as to power on the thermostat 740. In one or more embodiments, the power provided to the thermostat 740 by the A2L control board 750 is a 24 volt A/C power.

At step 814, the A2L control board 750 may be electrically coupled to the outdoor control board 731. In one or more embodiments, the high pressure switch 790 may be electrically coupled to the outdoor control board 731 such that when the high pressure switch 790 opens, the outdoor control board 731 shuts down. Further, the outdoor relay 780 may be electrically coupled to the high pressure switch 790 such that when the outdoor relay opens, the high pressure switch opens. Furthermore, the outdoor relay 780 may be electrically coupled to an outdoor unit contact point 767 of the A2L control board 750 by way of a wire capable of carrying 24 volt A/C power. Thus, by way of example, if outdoor unit relay 766 of the A2L control board 750 closes, a 24 volt A/C signal will be provided to the outdoor relay 780 which causes the outdoor relay 780 to open, which causes the high pressure switch 790 to open, which shuts down the outdoor unit 730, including the outdoor control board 731.

At step 816, the A2L control board 750 may be turned on, and the G wire relay 754, the Y1 wire relay 757, the Y2 wire relay 758, the alarm relay 759, the dry contact relay 764, and the outdoor unit relay 766 may be opened. In one or more embodiments, when the A2L control board 750 is turned on, the relays are in the default state, which includes the G wire relay 754, the Y1 wire relay 757, the Y2 wire relay 758, the alarm relay 759, the dry contact relay 764, and the outdoor unit relay 766 being closed. Thus, in order to make sure signals are not unnecessarily provided to the indoor control board 726 to turn on the blower motor 723, the outdoor unit 730 is not unnecessarily shut down by the high pressure switch, and the alarm and ventilator are not unnecessarily run, in one or more embodiments, when the A2L control board 750 powers up, the A2L control board opens the G wire relay 754, the Y1 wire relay 757, the Y2 wire relay 758, the alarm relay 759, the dry contact relay 764, and the outdoor unit relay 766.

At step 820, the A2L sensor 770 may be tested to confirm that it is properly operational. Once electrically coupled to the A2L control board 750, in one or more embodiments, the A2L sensor 770 may perform an internal diagnostic check to make sure that the sensor is operating properly and may detect an A2L refrigerant leak. If the diagnostic check is successful, the A2L sensor 770 may communicate the successful diagnostic check to the A2L control board 750, which can begin operation of the HVAC system 700. If the A2L sensor 770 fails the diagnostic check, the A2L sensor 770 will communicate the failed diagnostic check to the A2L control board 750, which will remain in the default configuration, keeping the HVAC system 700 from operating until the A2L sensor is repaired or replaced.

At step 830, the A2L control board 750 may begin operation of the HVAC system 700. In order to begin operation, in one or more embodiments, the A2L control board 750 may close the R wire relay 753 of the A2L control board 750. Closing the R wire relay 753 allows for the 24 volt A/C power of the A2L control board 750 to pass to the thermostat 740. Once power has been turned on for the thermostat 740, it may then be able to send signals to the indoor unit 720, through the A2L control board 750, and the HVAC system 700 may be fully operational.

At step 840, while the HVAC system is running, in one or more embodiments, the A2L sensor 770 may check for A2L refrigerant leaks. The A2L sensor 770 may continuously check for A2L refrigerant leaks while the HVAC system 700 is running, such that if a check comes back negative for an A2L refrigerant leak, the A2L sensor 770 repeats step 840. However, if the AL2 sensor 770 detects an A2L leak, then the A2L sensor 770 communicates the A2L refrigerant leak to the A2L control board and the HVAC system continues to step 850.

At step 850, the HVAC system 700, by way of the A2L control board 750, may perform safety measures to eliminate the threat of the detected A2L refrigerant leak. Specifically, the HVAC system 700 may (step 852) open the R wire relay 753, (step 853) close the G wire relay 754, (step 854) open the W1 wire relay 755 and the W2 wire relay 756, (step 855) close the Y1 wire relay 757 and the Y2 wire relay 758, (step 856) close the dry contact relay 764, (step 857) close the alarm relay 759, and (step 858) close the outdoor unit relay 766.

At step 852, opening the R wire relay 753 prevents the A2L control board 750 from distributing the 24 volt A/C power to the thermostat 740. Removing the 24 volt A/C power from the thermostat 740 ensures that only the signals passed from the A2L control board 750 may reach the indoor control board 726 and thus, the safety measures may be implemented by the HVAC system 700. Additionally, at step 853, closing the G wire relay 754 causes the A2L control board 750 to send a 24 volt A/C power along the G wire to the inside control board 726, which starts the blower motor 723 when it receives the signal along the G wire. Further, at step 854, opening the W1 wire relay 755 and the W2 wire relay 756 ensures that no signal is sent to the indoor control board 726 and thus, heating operations are not run while the system is experiencing a refrigerant leak. Furthermore, at step 855, closing the Y1 wire relay 757 and the Y2 wire relay 758 causes the A2L control board 750 to send a 24 volt A/C power along the Y1 and Y2 wires to the indoor control board 726. The indoor control board 726 interprets the signals along the Y1 and Y2 wires to call for first and second stage cooling operations, but because the compressor in the outdoor unit 730 is also being powered off in this step as discussed below, the only effect is that the indoor control board 726 runs the blower motor 732 at its highest level. Additionally, at step 858, closing the outdoor unit relay 766 causes a 24 volt A/C signal to travel to the outdoor relay 780, which causes the outdoor relay 780 to open, which causes the high pressure switch 790 to open, which causes the outdoor unit 730 to shut down completely.

Further, at step 856, closing the dry contact relay 764 causes the 24 volt A/C power from the A2L control board 750 to power an attached ventilator on if the HVAC system 700 includes a ventilator. Additionally, at step 857, closing the alarm relay 759 causes the 24 volt A/C power from the A2L control board 750 to power the alarm on, which includes, at least, powering on visual and auditory alarms in the form of the buzzer 762 and the LED 763.

Further, while listed as separate steps, one of ordinary skill would appreciate that in one or more embodiments, steps 852-858 may take place in any order, or in other embodiments, steps 852-858 may occur simultaneously. Additionally, one of ordinary skill in the art would appreciate that all steps 852-858 may be completed within the requisite time after detection of an A2L refrigerant leak as required by A2L safety standards.

Thus, in one or more embodiments, in response to a communication from the A2L sensor 770 that an A2L refrigerant leak has been detected, the A2L control board 750 may turn off the outdoor unit 730, turn on a ventilator if the HVAC system 700 has one, turn on visual and auditory alarms that an A2L refrigerant has been detected, and ensure that the only signals the indoor unit 720 will receive and act on will cause the blower motor 723 to be turned on as fast as it can go.

While the method 800 is described with respect to an HVAC system 700 including a single A2L sensor 770, one of ordinary skill in the art, would understand that any number of sensors may be used in the system and the method may include electrically coupling the further sensors to the control board, testing the further sensors, and communicating with the further sensors as the further sensors check for A2L refrigerant leaks.

Figure 9:
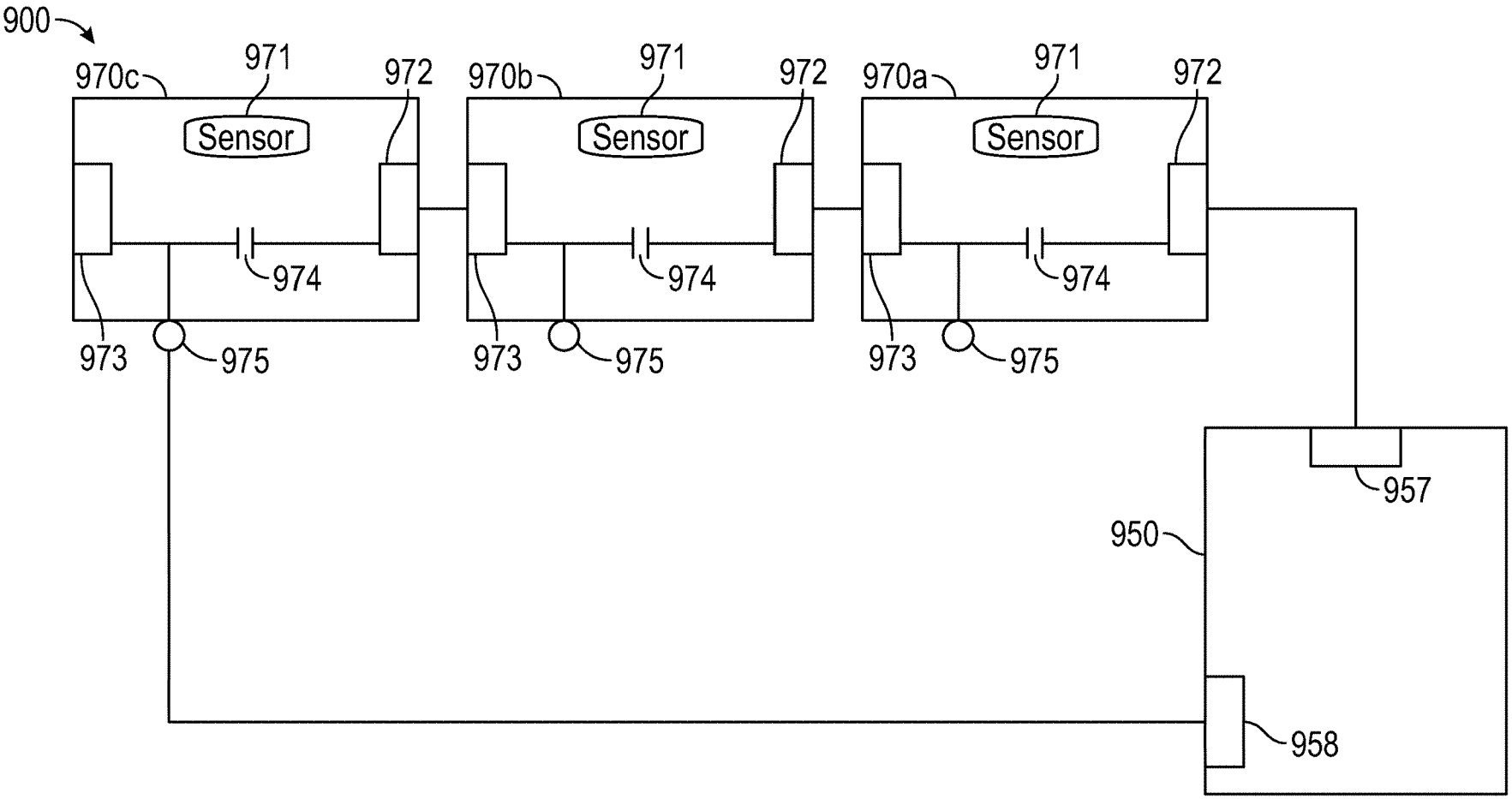
FIG. 9 is an illustrative configuration of A2L sensors for use in an HVAC system using an A2L refrigerant, according to one or more embodiments.

Referring now to FIG. 9, an illustrative configuration of A2L sensors for use in HVAC systems using an A2L refrigerant, according to one or more embodiments is shown. In one or more embodiments, an HVAC system 900 may include, in part, an A2L control board 950 and one or more A2L sensors 970*a*, 970*b*, 970*c*. Further, as discussed above with respect to FIGS. 1, 3, 5, and 7, the A2L sensors 970*a*, 970*b*, 970*c* may be electrically coupled to the A2L control board 950, such that the A2L sensors 970*a*, 970*b*, 970*c* may communicate an A2L refrigerant leak to the A2L control board 950 if one is detected. Further, in one or more embodiments, an RS-485 4 wire harness may be used to connect, at least, the first A2L sensor 970*a* to a first sensor connector 957 of the A2L control board 950. Further, while an RS-485 connection may used, one of ordinary skill in the art would understand that any method of communicatively and electrically coupling the A2L sensors to the A2L control board may be used. Additionally, in one or more embodiments, a feedback wire may be used to electrically couple a last A2L sensor 970*c* to a second sensor connector 958 of the A2L control board 950.

While each A2L sensor 970*a*, 970*b*, 970*c* and the A2L control board 950 are depicted as being electrically and communicatively coupled to each other by way of a wired connection, one of ordinary skill in the art would understand that each A2L sensor 970*a*, 970*b*, 970*c* and the A2L control board 950 may just be communicatively coupled wirelessly. In one or more embodiments, each A2L sensor 970*a*, 970*b*, 970*c* and the A2L control board 950 may be communicatively coupled by any wireless means, such as Wi-Fi or Bluetooth.

In one or more embodiments, each of the A2L sensors 970*a*, 970*b*, 970*c* may include sensing components 971, a bus connector input 972, a bus connector output 973, a sensor relay 974, and a sensor feedback port 975. The sensing components 971 may be configured to detect an A2L gas in the air and report the level detected. Additionally, the sensing components 971 may be configured to run internal diagnostic checks to make sure that the sensor is still operational.

Further, the bus connector input 972 and the bus connector output 973 may be physical connectors through which the sensor may be communicatively coupled to another sensor or the A2L control board 950. By way of example, on the first sensor 970*a*, the bus connector input 972 may be where an RS-485 4 wire harness is connected to the first A2L sensor 970*a* such that the first A2L sensor 970*a* is electrically coupled to the A2L control board 950. Also, by way of example, a bus connector output 973 of the first A2L sensor 970*a* may be where another RS-485 4 wire harness is connected to the first A2L sensor 970*a* such that the first A2L sensor 970*a* is electrically coupled to the second A2L sensor 970*b*.

Furthermore, in one or more embodiments, each A2L sensor may include a sensor relay 974. The sensor relay 974 may be electrically disposed between the bus connector input 972 and the bus connector output 973 such that when the sensor relay 974 is open, power is blocked from travelling from the bus connector input 972 to the bus connector output 973. Thus, when the sensor relay 974 is closed, power may travel from the bus connector input 972 to the bus connector output 973 and then to whatever is electrically coupled to the bus connector output 973. In one or more embodiments, the default position of the sensor relay 974 may be open. Further, in one or more embodiments, the sensor relay 974 may be configured to open if the sensor fails a diagnostic check. Thus, in one or more embodiments, the A2L control board 950 may learn that a sensor has failed by way of a loss of signal from the feedback wire coupled to a last A2L sensor 970*c*, and then the A2L control board may respond by turning off the functionality of the HVAC system 900.

Additionally, in one or more embodiments, each A2L sensor may include a sensor feedback port 975. In one or more embodiments, the sensor feedback port 975 may be used to send sensor feedback by way of a feedback wire. More specifically, in one or more embodiments, the signal, which may be analog or digital and wired or wireless, that is sent back to the A2L control board 950 by way of the sensor feedback port 975 may indicate that all sensors on the network have successfully completed their internal checks, are functioning properly, and there are no more sensors in the chain. The sensor feedback port 975 may be disposed on the sensor such that the sensor relay 974 is electrically disposed between the sensor feedback port 975 and the bus connector input 972. Thus, when the sensor relay 974 is open, power is blocked from travelling from the bus connector input 972 to the sensor feedback port 975. Further, when the sensor relay 974 is closed, power may travel from the bus connector input 972 to the sensor feedback port 975 and then to whatever is electrically coupled to the sensor feedback port 975.

In one or more embodiments, as shown in FIG. 9, the first A2L sensor 970*a*, the second A2L sensor 970*b*, and the last A2L sensor 970*c* may be connected in series and electrically coupled to the A2L control board 950. By way of example, the A2L control board 950 may be directly electrically coupled to the first A2L sensor by way of an RS-485 4 wire harness coupled between the first sensor connector 957 and the bus connector input 972 of the first A2L sensor 970*a*. Further, the first A2L sensor 970*a* may be directly coupled to the second A2L sensor 970*b* by way of an RS-485 4 wire harness coupled between the bus connector output 973 of the first A2L sensor 970*a* and the bus connector input 972 of the second A2L sensor 970*b*. Furthermore, the second A2L sensor 970*b* may be directly coupled to the last A2L sensor 970*c* by way of an RS-485 4 wire harness coupled between the bus connector output 973 of the second A2L sensor 970*b* and the bus connector input 972 of the last A2L sensor 970*c*. Additionally, the last A2L sensor 970*c* may be directly coupled to the A2L control board 950 by way of a feedback wire coupled between the sensor feedback port 975 of the last A2L sensor 970*c* and the second sensor connector 958 of the A2L control board.

One of ordinary skill in the art, using common sense, would understand that the configuration of A2L sensors 970*a*, 970*b*, 970*c* as described above with respect to FIG. 9 may be utilized in any of the HVAC systems 100, 300, 500, 700 described above with respect to FIGS. 1-8. Further, while only one sensor architecture is shown in FIG. 9, one of ordinary skill in the art, using common sense, would understand that any A2L sensors may be used. Furthermore, one of ordinary skill in the art would understand that the configuration of sensors as shown in FIG. 9 works with any A2L sensor that has a power input and a power output separated by any type of switch that prevents power from reaching the power output until the sensor has passed internal diagnostics. Additionally, while the sensor architecture is described as using an RS-485 4 wire harness in a number of locations, one of ordinary skill in the art would understand that any form of connecting the sensors and the A2L control board that allows for two-way communication may be used, whether digital or analog and wired or wireless. Further, while three sensors are shown in FIG. 9, one of ordinary skill in the art would understand that two sensors may be used in series in the same manner described above, or a single sensor may be used instead.

Figure 10:
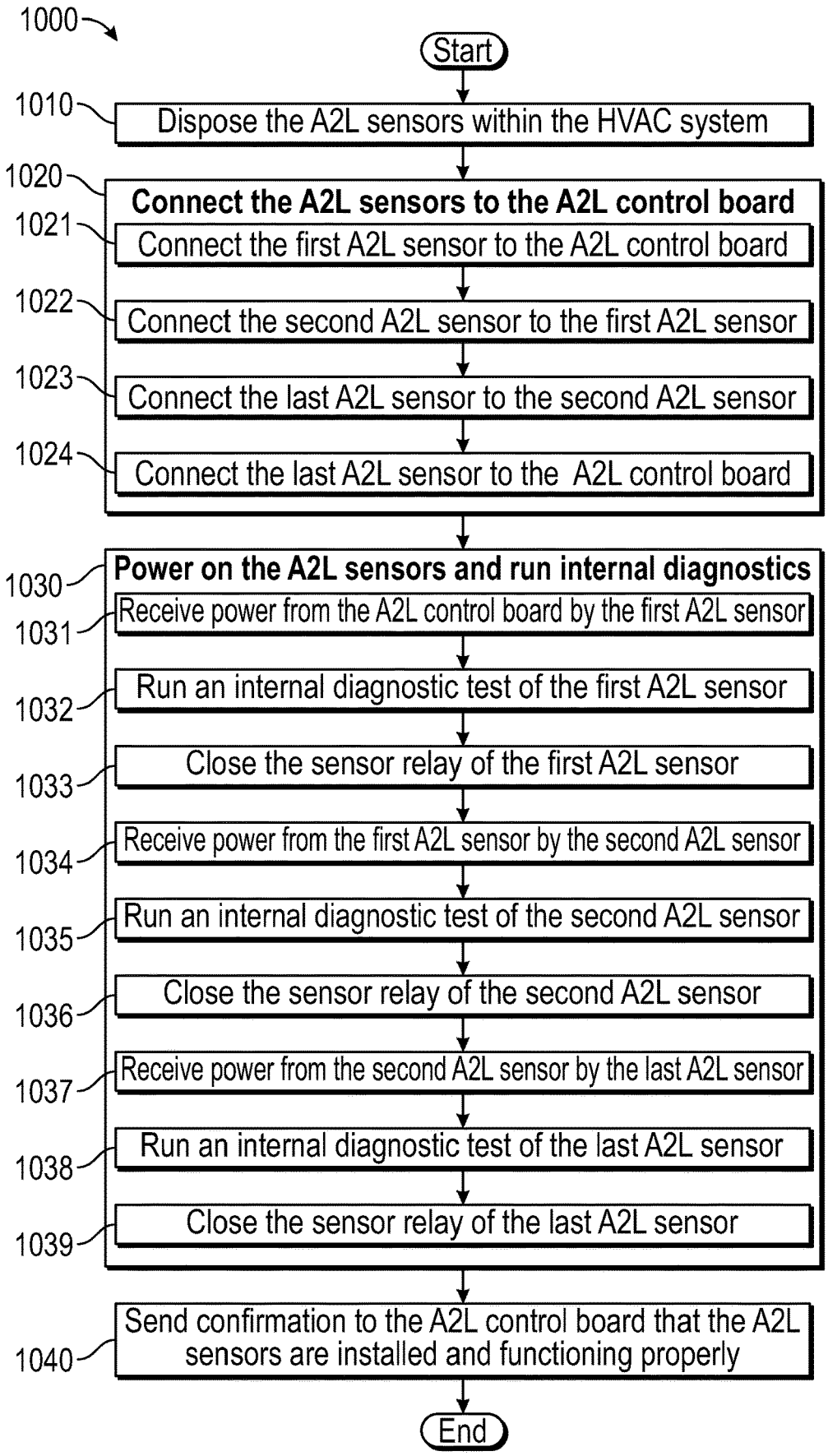
FIG. 10 is a flow chart illustrating an embodiment of a method of installing and testing a configuration of A2L sensors for use in an illustrative configuration of A2L sensors for use in an HVAC system using an A2L refrigerant, according to one or more embodiments.

Referring now to FIG. 10, a flow chart of a method of installing and testing a configuration of A2L sensors as described above with regard to FIG. 9 for an HVAC system using an A2L refrigerant, according to one or more embodiments, is illustrated. The method 1000 may include one or more of the following: (step 1010) disposing the A2L sensors 970*a*, 970*b*, 970*c* within the HVAC system 900; (step 1020) connect the A2L sensors 970*a*, 970*b*, 970*c* to the A2L control board 950; (step 1030) power each of the A2L sensors 970*a*, 970*b*, 970*c* on and run internal diagnostics; (step 1040) send confirmation to the A2L control board 950 that the A2L sensors are all installed and functioning properly.

At step 1010, each of the A2L sensors 970*a*, 970*b*, 970*c* may be disposed within the HVAC system 900 as necessary to make sure that any A2L refrigerant leaks that may occur are detected almost immediately. By way of example, disposing the A2L sensors 970*a*, 970*b*, 970*c* within the HVAC system 900 may include at least, finding a distinct place for each A2L sensor 970*a*, 970*b*, 970*c* that is adjacent to an evaporator coil of the indoor unit of the HVAC system 900 and coupling each sensor 970*a*, 970*b*, 970*c* thereto.

Further, at step 1020, the A2L sensors 970*a*, 970*b*, 970*c* may be coupled to the A2L control board 950. Coupling the A2L sensors 970*a*, 970*b*, 970*c* to the A2L control board 950 may include, at least: (step 1021) connecting the first A2L sensor 970*a* to the A2L control board 950; (step 1022) connecting the second A2L sensor 970*b* to the first A2L sensor 970*a*; (step 1023) connecting the last A2L sensor 970*c* to the second A2L sensor 970*b*; and (step 1024) connecting the last A2L sensor 970*c* to the A2L control board 950.

At step 1021, the first A2L sensor 970*a* may be connected to the A2L control board 950. In one or more embodiments, connecting the first A2L sensor 970*a* to the A2L control board 950 may include attaching an RS-485 bus on one end to a first sensor connector 957 of the A2L control board 950 and on the other end to a bus connector input 972 of the first A2L sensor 970*a*. Further, at step 1022, the first A2L sensor 970*a* may be connected to the second A2L sensor 970*b*. In one or more embodiments, connecting the first A2L sensor 970*a* to the second A2L sensor 970*b* may include attaching an RS-485 bus on one end to a bus connector output 973 of the first A2L sensor 970*a* and on the other end to a bus connector input 972 of the second A2L sensor 970*b*. Furthermore, at step 1023, the second A2L sensor 970*b* may be connected to the last A2L sensor 970*c*. In one or more embodiments, connecting the second A2L sensor 970*b* to the last A2L sensor 970*c* may include attaching an RS-485 bus on one end to a bus connector output 973 of the second A2L sensor 970*b* and on the other end to a bus connector input 972 of the last A2L sensor 970*c*. Additionally, at step 1024, the last A2L sensor 970*c* may be connected to the A2L control board 950. In one or more embodiments, connecting the last A2L sensor 970*c* to the A2L control board 950 may include attaching a feedback line on one end to a sensor feedback port 975 of the last A2L sensor 970*c* and on the other end to a second sensor connector 958 of the A2L control board 950.

At step 1030, each of the A2L sensors 970*a*, 970*b*, 970*c* may be powered on and run through internal diagnostics. Powering on and testing each of the A2L sensors may include, at least: the first A2L sensor 970*a* (step 1031) receiving power from the A2L control board 950, (step 1032) running an internal diagnostic test, and, if it passed the internal diagnostic test, (step 1033) closing sensor relay 974 of the first A2L sensor 970*a*; the second A2L sensor 970*b* (step 1034) receiving power from the first A2L sensor 970*a*, (step 1035) running an internal diagnostic test, and, if it passed the internal diagnostic test, (step 1036) closing sensor relay 974 of the second A2L sensor 970*b*; the last A2L sensor 970*c* (step 1037) receiving power from the second A2L sensor 970*b*, (step 1038) running an internal diagnostic test, and, if it passed the internal diagnostic test, (step 1039) closing sensor relay 974 of the last A2L sensor 970*c*.

At step 1031, once the A2L sensors 970*a*, 970*b*, 970*c* are physically coupled to the A2L control board 950, the A2L control board 950 may send power to the first A2L sensor 970*a*, which the first A2L sensor 970*a* may receive and use to power on. Further, at step 1032, the first A2L sensor 970*a* may run an internal diagnostic check of the sensing components 971, in which the first A2L sensor 970*a* confirms whether the sensing components 971 are functioning properly. Additionally, at step 1033, if the first A2L sensor 970*a* passed the internal diagnostic check, then the first sensor 970*a* may close the sensor relay 974, which allows power to travel from the bus connector input 972 to the bus connector output 973 and the sensor feedback port 975.

At step 1034, once the first A2L sensor 970*a* closes its sensor relay 974, the first A2L sensor 970*a* may send power to the second A2L sensor 970*b*, which the second A2L sensor 970*b* may receive and use to power on. Further, at step 1035, the second A2L sensor 970*b* may run an internal diagnostic check of the sensing components 971, in which the second A2L sensor 970*b* confirms whether the sensing components 971 are functioning properly. Additionally, at step 1036, if the second A2L sensor 970*b* passed the internal diagnostic check, then the second sensor 970*b* may close the sensor relay 974, which allows power to travel from the bus connector input 972 to the bus connector output 973 and the sensor feedback port 975.

At step 1037, once the second A2L sensor 970*b* closes its sensor relay 974, the second A2L sensor 970*b* may send power to the last A2L sensor 970*c*, which the last A2L sensor 970*c* may receive and use to power on. Further, at step 1038, the last A2L sensor 970*c* may run an internal diagnostic check of the sensing components 971, in which the last A2L sensor 970*c* confirms whether the sensing components 971 are functioning properly. Additionally, at step 1039, if the last A2L sensor 970*c* passed the internal diagnostic check, then the last sensor 970*c* may close the sensor relay 974, which allows power to travel from the bus connector input 972 to the bus connector output 973 and the sensor feedback port 975.

At step 1040, once the last A2L sensor 970*c* closes its sensor relay 974, the last A2L sensor 970*c* may send power to the A2L control board 950 by way of the feedback line connected between the sensor feedback port 975 of the last A2L sensor 970*c* and the second sensor connector 958 of the A2L control board 950. Receiving this feedback signal from the last A2L sensor 970*c* notifies the A2L control board 950 that all sensors on the network have successfully completed their internal checks, are functioning properly, and there are no more sensors in the chain that need to be connected and tested. This is so, because, at any point in the chain of sensors, if there is a failure of a sensor, the sensor relay will not close, and thus, all subsequent sensors in the chain and the feedback port of the last sensor in the chain will not receive power and the A2L control board will not receive the feedback it needs.

One of ordinary skill in the art, using common sense, would understand that the method 1000 of installation and testing of A2L sensors 970*a*, 970*b*, 970*c* as described above with respect to FIG. 10 may be utilized in any of the methods 200, 400, 600, 800 described above with respect to FIGS. 1-8. Further, while only one sensor architecture is described by the method of FIG. 10, one of ordinary skill in the art, using common sense, would understand that any A2L sensors may be used. Furthermore, one of ordinary skill in the art would understand that the configuration of sensors as described in the method 1000 of FIG. 10 works with any A2L sensor that has a power input and a power output separated by any type of switch that prevents power from reaching the power output until the sensor has passed internal diagnostics. Additionally, while the sensor architecture is described as using an RS-485 4 wire harness in a number of locations, one of ordinary skill in the art would understand that any form of connecting the sensors and the A2L control board that allows for two-way communication may be used, whether digital or analog and wired or wireless. Further, while the installation and testing of three sensors is described by method 1000, one of ordinary skill in the art would understand that two sensors may be used in series in the same manner described above, or a single sensor may be used instead.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, feature, functions, operations, or steps, any of these embodiments may include any combination or permutation of any of the components, elements, features, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative.

What is claimed is:

1. A method for conditioning air in a building, the method comprising:

running a first internal self-diagnostic test on a first A2L sensor;

running a second internal self-diagnostic test on a second A2L sensor, wherein:

the first A2L sensor and the second A2L sensor are electrically coupled in series to an A2L control board; and each of the first A2L sensor and the second A2L sensor comprises a sensing component configured to detect an amount of an A2L refrigerant; and turning on an air temperature controller using the A2L control board when the first A2L sensor passes the first internal self-diagnostic test, and the second A2L sensor passes the second internal self-diagnostic test.

2. The method of claim 1, wherein each of the first A2L sensor and the second A2L sensor comprises:

a bus connector input;

a bus connector output;

a sensor relay electrically disposed between the bus connector input and the bus connector output; and a sensor feedback port electrically disposed between the sensor relay and the bus connector output.

3. The method of claim 2, wherein;

the A2L control board includes a first sensor connector and a second sensor connector;

the bus connector input of the first A2L sensor is electrically and communicatively coupled to the first sensor connector of the A2L control board;

the bus connector output of the first A2L sensor is electrically and communicatively coupled to the bus connector input of the second A2L sensor; and the sensor feedback port of the second A2L sensor is electrically coupled to the second sensor connector of the A2L control board.

4. The method of claim 3, further comprising:

providing power from the A2L control board to the first A2L sensor;

providing power from the first A2L sensor to the second A2L sensor when the first A2L sensor passes the first internal self-diagnostic test;

providing a feedback signal from the sensor feedback port of the second A2L sensor to the A2L control board, when the second A2L sensor passes the second internal self-diagnostic test; and turning on the air temperature controller using the A2L control board in response to receiving the feedback signal at the A2L control board.

5. The method of claim 4, further comprising:

closing the sensor relay of the first A2L sensor when the first A2L sensor passes the first internal self-diagnostic test; and closing the sensor relay of the second A2L sensor when the second A2L sensor passes the second internal self-diagnostic test.

6. The method of claim 2, wherein:

a default status of the sensor relay of the first A2L sensor is open; and a default status of the sensor relay of the second A2L sensor is open.

7. An air temperature controller for conditioning air inside a building, comprising:

an indoor unit disposed inside the building, the indoor unit having a heat exchanger that uses an A2L refrigerant;

an outdoor unit disposed outside the building, wherein the outdoor unit is electrically coupled to the indoor unit;

an A2L control board electrically coupled to one or more of the indoor unit and the outdoor unit;

a first A2L sensor disposed within the indoor unit and electrically coupled to the A2L control board; and a second A2L sensor disposed within the indoor unit and electrically coupled to the A2L control board, wherein:

the first A2L sensor and the second A2L sensor are coupled in series to the A2L control board; and each of the first A2L sensor and the second A2L sensor comprises a sensor component configured to detect an amount of the A2L refrigerant in the air temperature controller.

8. The air temperature controller of claim 7, wherein the A2L control board is configured to:

receive a feedback signal from one of the first A2L sensor and the second A2L sensor indicating that both the first A2L sensor and the second A2L sensor have passed respective first and second self-diagnostic tests; and in response to receiving the feedback signal, turn on one or more of the indoor unit and the outdoor unit.

9. The air temperature controller of claim 7, wherein each of the first A2L sensor and the second A2L sensor comprises:

a bus connector input;

a bus connector output; and a sensor relay electrically disposed between the bus connector input and the bus connector output.

10. The air temperature controller of claim 9, wherein:

the first A2L sensor is configured to close the sensor relay of the first A2L sensor if the first A2L sensor passes a first internal self-diagnostic test; and the second A2L sensor is configured to close the sensor relay of the second A2L sensor if the second A2L sensor passes a second internal self-diagnostic test.

11. The air temperature controller of claim 9, wherein each of the first A2L sensor and the second A2L sensor comprises a sensor feedback port electrically disposed between the sensor relay and the bus connector output.

12. The air temperature controller of claim 11, wherein:

the A2L control board comprises a first sensor connector and a second sensor connector;

the bus connector input of the first A2L sensor is electrically and communicatively coupled to the first sensor connector of the A2L control board;

the bus connector output of the first A2L sensor is electrically and communicatively coupled to the bus connector input of the second A2L sensor; and the sensor feedback port of the second A2L sensor is electrically coupled to the second sensor connector of the A2L control board.

13. The air temperature controller of claim 12, wherein:

the A2L control board is configured to turn on one or more of the indoor unit and the outdoor unit of the air temperature controller in response to receiving a feedback signal from the sensor feedback port of the second A2L sensor; and the sensor feedback port of the second A2L sensor does not receive power to send the feedback signal until the second A2L sensor passes an internal self-diagnostic test and the sensor relay of the second A2L sensor is closed.

14. The air temperature controller of claim 9, wherein:

a default status of the sensor relay of the first A2L sensor is open; and a default status of the sensor relay of the second A2L sensor is open.

* * * * *